US005579825A

United States Patent [19]

Shibata et al.

[11] Patent Number: 5,579,825

[45] Date of Patent: Dec. 3, 1996

[54] DIE CASTING METHOD AND DIE CASTING MACHINE

[75] Inventors: Ryoichi Shibata, Ishibashi-machi; Takao Kaneuchi, Mooka, both of Japan

[73] Assignee: Hitachi Metals, Ltd., Tokyo, Japan

[21] Appl. No.: 357,260

[22] Filed: Dec. 13, 1994

[30] Foreign Application Priority Data

| | | | |
|---|---|---|---|
| Dec. 13, 1993 | [JP] | Japan | 5-312135 |
| Jun. 22, 1994 | [JP] | Japan | 6-139915 |
| Nov. 4, 1994 | [JP] | Japan | 6-271333 |
| Dec. 5, 1994 | [JP] | Japan | 6-330017 |

[51] Int. Cl.[6] ..... B22D 17/20; B22D 17/00

[52] U.S. Cl. ..... 164/493; 164/113; 164/312; 164/513; 164/900

[58] Field of Search ..... 164/113, 312, 164/513, 493, 498, 147.1, 900

[56] References Cited

U.S. PATENT DOCUMENTS 5,156,202 10/1992 Sick et al. ..... 164/493

FOREIGN PATENT DOCUMENTS 51-12328 1/1976 Japan .
54-43976 12/1979 Japan .
61-119368 6/1986 Japan ..... 164/493
2-51703 11/1990 Japan .
3-13260 1/1991 Japan .
3-221253 9/1991 Japan .
5-192754 8/1993 Japan .
6-83888 10/1994 Japan .

*Primary Examiner*—Kuang Y. Lin
*Attorney, Agent, or Firm*—Sughrue, Mion, Zinn, Macpeak & Seas

[57] ABSTRACT

A die casting method and a die casting machine of the invention is provided. The method comprises the steps of forming a casting sleeve comprising an inner cylinder and an outer cylinder, having a conductor material, and disposing an induction coil on the outer periphery of the outer cylinder. The conductor material may be in the form of a plurality of conductors uncontinuously disposed about the cylinder or it may be in the form of a single conducting material having a plurality of slits. A material to be cast in the casting sleeve may be heated, maintained a constant temperature and stirred by electromagnetic induction. The material may be substantially separated from the wall face of the casting sleeve by an electromagnetic force generated between the conductor and the material and the temperature drop of the material may be suppressed. The material being casted can efficiently be heated, maintained a constant temperature and electromagnetically stirred, while maintaining the machine accuracy of the casting sleeve.

50 Claims, 32 Drawing Sheets

DIE CASTING METHOD AND DIE CASTING MACHINE

FIELD OF THE INVENTION

This invention relates to a die casting method and a die casting machine for producing a high-quality die-cast member.

BACKGROUND OF THE INVENTION

FIG. 38 and FIG. 39 each show a sectional view of the essential part of generally used die casting machines. In the case of the horizontal die casting machine of FIG. 38, molten metal 31 taken by a ladle 37 from a holding furnace is poured into a casting sleeve 30 from an inlet. The poured molten metal 31 is injected at a low speed by a plunger chip 33 in an early stage and charged into a cavity 36 formed by closing a die 34 and a die 35 through a high-speed injection in a later stage. In case of the vertical die casting machine of FIG. 39, molten metal 31 is poured into a cup 38, dies 34 and 35 are closed and the molten metal 31 is charged into a cavity 36 by the same way as in the case of the horizontal die casting machine. In FIG. 39, the components same with those of FIG. 38 are given the same reference numerals as used in FIG. 38, and their description is omitted.

The casting sleeve is generally kept at a low temperature to keep its machine accuracy and to prevent oxidation. This causes partial solidification of the molten metal when pouring. If solidified pieces are supplied into the cavity together with the molten metal, casting defects are caused and mechanical properties of a product may be deteriorated.

The casting sleeves, which are in a single-layered integral form made of metal, e.g., stainless steel, as shown in FIG. 38 and FIG. 39, have such a high heat conductivity that the molten metal is quickly cooled and viscosity of the molten metal is increased to lower fluidity making forced charging by a plunger difficult.

In conventional die casting, well-known methods include rheocasting and compocasting which vigorously stir a semi solid metal or composite material to break dendrite structures so as to continuously produce a slurry-state metal having lowered viscosity and feed the slurry-state metal into the die casting machine, and thixocasting and other techniques which once solidify a slurry-state metal and reheat it into a semi solid state to feed into the die casting machine.

In the above cases, the casting sleeve is also kept at a low temperature as described above, the molten metal is cooled and its viscosity is increased, lowering fluidity. Therefore, these casting processes cannot be used to produce a thin and long member because short runs and cold shuts occur in such casting processes. In these prior art processes, the dendrite structure may remain on the surface layer of the molten metal as disclosed in Japanese Patent Publication No. 2-51703, because these processes are designed to prevent the surface layer from entering into a product. In Japanese Patent Application Laid-open Prints No. 3-221253 and No. 3-13260, the surface of a molten metal is prevented from entering into a product, because the material surface is oxidized when preheated prior to being melted. Although the dies and the die casting methods are specially devised, good results may not be always obtained.

To remedy the above problems, Japanese Patent Publication No. 54-43976 discloses a die casting machine whose casting sleeve is made of a heat-resistant material such as a ceramic material.

The casting sleeve has its inner cylinder made of a heat-resistant material such as a ceramic or cermet, and its outer cylinder is shrinkage-fitted or internal-chilled with a reinforcing member made of iron, cast iron, cast steel or an ultra heat resistant alloy, such as a tungsten group alloy or a molybdenum group alloy, to apply a compressive stress to enhance the mechanical strength of the casting sleeve. The die casting machine is provided with a cooling means forcibly cooling the outer periphery of the reinforcing member partly or entirely with water or air, thereby permanently retaining the compressive stress against the casting sleeve.

Referring to FIG. 40, the above prior art is described in detail. A cavity 44 is formed by closing a die (movable die) 41 and a die (stationary die) 42 fixed to a main body (die plate) 43 of the die casting machine. A casting sleeve 45 is fixed to the die (stationary die) 42 in communication with the cavity 44. This casting sleeve 45 is made of ceramics or cermet so as to excel in heat resistance, corrosion resistance and abrasion resistance, hardly become wet with molten metal, and have a low thermal conductivity. The casting sleeve 45 has an inlet 46 formed and a plunger 47 is slidably disposed within the casting sleeve 45.

The molten metal poured through the inlet 46 is once stored in the casting sleeve 45, then the plunger 47 advances swiftly to charge the molten metal into the cavity 44 under pressure, and the charged molten metal is pressurized by the plunger 47 and solidified. After the molten metal solidification, the die 41 and the plunger 47 move back to provide a die-cast product.

Even in the above die casting machine, however, there are disadvantages, because the molten metal is still cooled by the inner cylinder of the casting sleeve to produce solidified pieces which may cause casting defects degrading the mechanical properties of a product if these solidified pieces are supplied into the cavity together with the molten metal. When the above die casting machine is applied to the rheocasting method, compocasting method or thixocasting method, the molten metal is cooled by the inner cylinder, so that short runs and cold shuts still occur in casting a thin and long member making the application of the machine difficult.

Japanese Patent Publication No. 6-83888 discloses a die casting machine which applies a high-frequency current to oscillating coils so as to cause electromagnetic induction, thereby retaining the molten metal in a non-contact state with respect to the injection sleeve wall and the plunger chip end face. Since the molten metal is not contacted with the injection sleeve wall and the plunger chip end face, the molten metal is heat-insulated resulting in prevention of an initial solidified layer and defective cold shuts.

In FIG. 41 showing the above die casting machine, the molten metal is poured into a runner 52 with a plunger chip 50 positioned at the lower part in an injection sleeve 51, a high-frequency current of 1000 Hz is supplied from a power unit to oscillating coils 54 and 55 which are respectively disposed at a wall 53 of the sleeve 51 and within the plunger chip 50, a repulsion force is generated between the molten metal and the wall 53 or the plunger chip 50 by the action of electromagnetic induction because of the conductivity of the molten metal, and the molten metal is held in a floated state within the sleeve 51 due to this repulsion force.

The above die casting machine has difficulty in precisely holding the molten metal in a non-contact state with respect the wall 53 or the plunger chip 50 by the action of a high-frequency current. To conduct secure holding of the molten metal in a non-contact state, the range for setting an a.c., e.g. the band for setting the frequency of an a.c., may be limited. This may cause the electromagnetic stirring for the molten metal to be insufficiently conducted.

In addition, the sleeve 51 is liable to be deformed by heating in the process of above electromagnetic induction by the molten metal, resulting in deterioration of the proper fitting of the plunger chip 50 into the sleeve 51. If the sleeve 51 is cooled to avoid the deforming caused by the induction heating, the molten metal in the sleeve 51 is hardly heated.

SUMMARY OF THE INVENTION

An object of this invention is to provide a die casting method and a die casting machine in which a temperature drop of a material before casting is small due to an induction heating caused by means of conductors and an induction coil, thereby producing a high quality product.

Another object of this invention is to provide a die casting method and a die casting machine by which a thin and long product can be produced, the temperature of a casting sleeve can be kept low, and the machine accuracy of the casting sleeve can be retained.

Still another object of the invention is to provide a die casting method and a die casting machine in which the temperature drop of a material to be cast is small by maintaining the material in substantially non-contact state with respect to a casting sleeve inner surface due to an electromagnetic force generated by means of conductors and an induction coil, thereby producing a high quality product, wherein production conditions, particularly the frequency of an a.c. applied to the induction coil, can be set at a desired band.

A die casting method of the invention comprises the steps of disposing a plurality of conductors uncontinuously around a material to be cast, disposing an induction coil outside of the material, generating a magnetic field at the conductors by means of the induction coil to cause induction heating and electromagnetic stirring of the material to be cast, thereby keeping the material in a semi solid state, and charging the material in a cavity by a forced entry means.

Further, a die casting method of this invention comprises the steps of disposing a conductor having a plurality of slits around a material to be cast, disposing an induction coil around the conductor, generating a magnetic field at the conductor by means of the induction coil to cause induction heating and electromagnetic stirring of the material accommodated inside of the conductor, thereby keeping the material in a semi solid state, and charging the material in a cavity by a forced entry means.

In above methods, induction heating and electromagnetic stirring of the material can be made in a casting sleeve.

Furthermore. a die casting method of this invention comprises the steps of forming a casting sleeve comprising an inner cylinder and an outer cylinder, forming at least a part of the inner cylinder with a substance having a low thermal conductivity and at least a part of the outer cylinder with a conductor having a plurality of slits, disposing an induction coil on the outer periphery of the outer cylinder, generating a magnetic field at the conductor by means of the induction coil to inductively heat and electromagnetically stir the material in the casting sleeve, thereby keeping the material in a semi solid state, and charging the material in a cavity by a forced entry means.

In addition, a die casting method of this invention comprises the steps of forming a casting sleeve comprising an inner cylinder and an outer cylinder, forming at least a part of the inner cylinder with a substance having a low thermal conductivity, disposing a plurality of conductors uncontinuously for at least a part of the outer cylinder of the casting sleeve, disposing an induction coil on the outer periphery of the outer cylinder, generating a magnetic field at the conductors by means of the induction coil to inductively heat and electromagnetically stir the material in the casting sleeve, thereby keeping the material in a semi solid state, and charging the material in a cavity by a forced entry means.

A die casting machine of the invention comprises a cavity formed by closed dies, an accommodating section for housing and heating a material to be cast which is communicated with the cavity, a conducting section comprising a plurality of conductors disposed uncontinuously at outer circumference of the accommodating section, and an induction coil wound on the outer periphery of the conducting section.

Further, a die casting machine of the invention comprises a cavity formed by closed dies, an accommodating section for housing and heating a material to be cast which is communicated with the cavity, a conductor having a plurality of slits and disposed at outer circumference of the accommodating section, and an induction coil wound on the outer periphery of the conductor.

Furthermore, a die casting machine of the invention comprises a cavity formed by closed dies, a casting sleeve disposed in communication with the product cavity and comprising an inner cylinder and an outer cylinder, and an induction coil wound on the outer periphery of the casting sleeve. The inner cylinder of the casting sleeve is at least partly made of a substance having a low thermal conductivity and the outer cylinder is at least partly made of a conductor having a plurality of slits.

In addition, a die casting machine of the invention comprises a product cavity formed by closed dies, a casting sleeve disposed in communication with the product cavity and comprising an inner cylinder and an outer cylinder, and an induction coil wound on the outer periphery of the casting sleeve. The inner cylinder of the casting sleeve is at least partly made of a substance having a low thermal conductivity and the outer cylinder is at least partly disposed uncontinuously with a plurality of conductors.

DETAILED DESCRIPTION OF THE INVENTION

Figure 1:
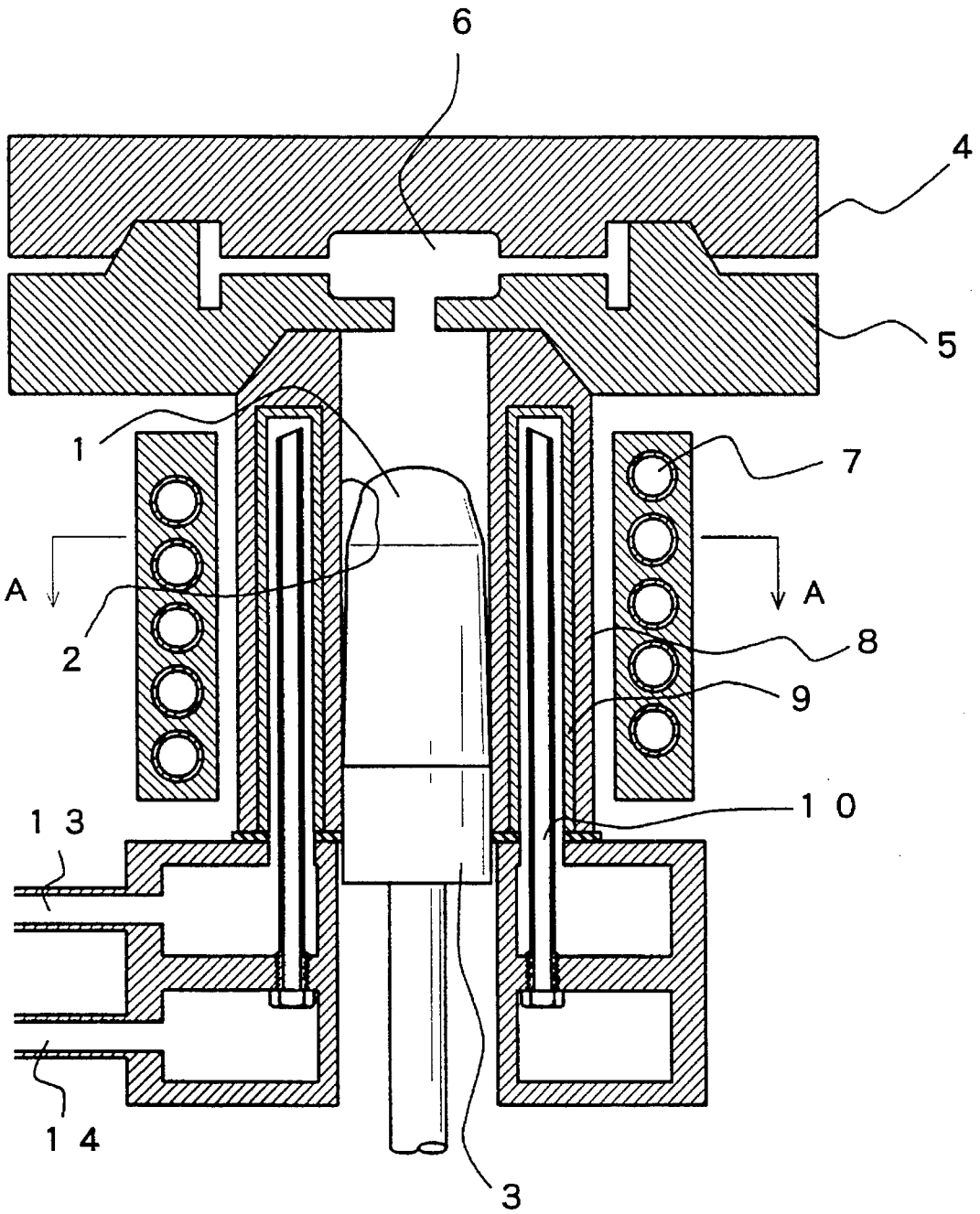
FIG. 1 is a schematic sectional view of a vertical type die casting machine according to one embodiment of the invention.

A die casting method of the invention comprises the steps of disposing a plurality of conductors uncontinuously around a material to be cast, disposing an induction coil outside of the material, generating a magnetic field at the conductors by means of the induction coil to cause induction heating and electromagnetic stirring of the material to be cast, thereby keeping the material in a semi solid state, and charging the material in a cavity by a forced entry means.

Further, a die casting method of this invention comprises the steps of disposing a conductor having a plurality of slits around a material to be cast, disposing an induction coil around the conductor, generating a magnetic field at the conductor by means of the induction coil to cause induction heating and electromagnetic stirring of the material accommodated inside of the conductor by induction heating, thereby keeping the material in a semi solid state, and charging the material in a cavity by a forced entry means.

In above methods, induction heating and electromagnetic stirring of the material can be made in a casting sleeve.

Furthermore, a die casting method of this invention comprises the steps of forming a casting sleeve comprising an inner cylinder and an outer cylinder, forming at least a part of the inner cylinder with a substance having a low thermal conductivity and at least a part of the outer cylinder with a conductor having a plurality of slits, disposing an induction coil on the outer periphery of the outer cylinder, generating a magnetic field at the conductor by means of the induction coil to inductively heat and electromagnetically stir the material in the casting sleeve by, thereby keeping the material in a semi solid state, and charging the material in a cavity by a forced entry means.

In addition, a die casting method of this invention comprises the steps of forming a casting sleeve comprising an inner cylinder and an outer cylinder, forming at least a part of the inner cylinder with a substance having a low thermal conductivity, disposing a plurality of conductors uncontinuously for at least a part of the outer cylinder of the casting sleeve, disposing an induction coil on the outer periphery of the outer cylinder, generating a magnetic field at the conductors by means of the induction coil to inductively heat and electromagnetically stir the material in the casting sleeve, thereby keeping the material in a semi solid state, and charging the material in a cavity by a forced entry means.

A ceramic material known as SIALON can be used as the substance having a low thermal conductivity.

The conductors may, optionally, be partly connected to maintain stable construction of the machine or to improve temperature distribution for the material.

In the above die casting methods, a plurality of conductors can be disposed uncontinuously in the forced entry means forcibly charging a material into the cavity or the forced entry means can be made of a conductor having a plurality of slits so that a magnetic field is generated at the forced entry means by means of the outer induction coil. A non-magnetic insulator can be attached to an end of the forced entry means which corresponds to the material to be cast.

According to the methods of the invention, it is possible to keep the material to be cast partly or entirely away from contact faces of the casting sleeve and the forced entry means by an electromagnetic force generated between the material and the casting sleeve or the forced entry means, thereby preventing a temperature drop of the material caused by its contact with the casting sleeve inner surface.

The conductors are preferably made of a non-magnetic material. Thus, the non-contact state of the material to the inner face of the casting sleeve by an electromagnetic force can be held more securely and efficiently.

An a.c. passed through the induction coil preferably has its frequency set at 300 Hz to 1000 Hz. When the frequency is less than 300 Hz, the non-contact state of the material to the inner face of the sleeve cannot be held sufficiently. When the frequency exceeds 1000 Hz, the material cannot be stirred enough by the a.c.

The material to be cast before the forced charging in the cavity desirably contains 10 to 80% of a solid phase. The cast material can be supplied in a semi solid, molten or solid state in the casting sleeve. Even if dendrite structure is partly or entirely contained within the supplied material, at least the surface of the material becomes flowable in the heating process and the solid phase is granulated with breaking of the dendrite structure.

Inert gas such as argon gas or nitrogen gas is charged into the casting sleeve in order to control a temperature in the sleeve, thereby maintaining the material in a semi solid state. And the conductor within the casting sleeve is cooled with air or water so as to avoid its temperature rising thereby preventing the conductor from being deformed or oxidized and keeping machine accuracy.

A die casting machine of the invention comprises a cavity formed by closed dies, an accommodating section for housing and heating a material to be cast which is communicated with the cavity, a conducting section comprising a plurality of conductors uncontinuously disposed at the outer circumference of the accommodating section, and an induction coil wound on the outer periphery of the conducting section.

Further, a die casting machine of the invention comprises a cavity formed by closed dies, an accommodating section for housing and heating a material to be cast which is communicated with the cavity, a conductor having a plurality of slits and disposed at the outer circumference of the accommodating section, and an induction coil wound on the outer periphery of the conductor.

In above machines, induction heating and electromagnetic stirring of the material can be made in a casting sleeve.

Furthermore, a die casting machine of the invention comprises a cavity formed by closed dies, a casting sleeve disposed in communication with the cavity and comprising an inner cylinder and an outer cylinder, and an induction coil wound on the outer periphery of the casting sleeve. The inner cylinder of the casting sleeve is at least partly made of a substance having a low thermal conductivity and the outer cylinder is at least partly made of a conductor having a plurality of slits.

In addition, a die casting machine of the invention comprises a product cavity formed by closed dies, a casting sleeve disposed in communication with the cavity and comprising an inner cylinder and an outer cylinder, and an induction coil wound on the outer periphery of the casting sleeve. The inner cylinder of the casting sleeve is at least partly made of a substance having a low thermal conductivity and the outer cylinder is at least partly disposed uncontinuously with a plurality of conductors.

In the above die casting machines, a plurality of conductors can be disposed uncontinuously in the forced entry means or the forced entry means can be made of a conductor having a plurality of slits so that a magnetic field is generated at the forced entry means by means of the outer induction coil. A non-magnetic insulator can be attached to an end of the forced entry means which corresponds to the material to be cast.

The conductors are desired to be made of a non-magnetic material. A ceramic material known as SIALON can be used as the substance having a low thermal conductivity.

It is preferable to dispose cooling medium passages in the outer cylinder to cool the conductor.

In the above die casting machines of the invention, a non-conductive substance is charged between neighboring conductors to prevent the molten metal from leaking.

Figure 35:
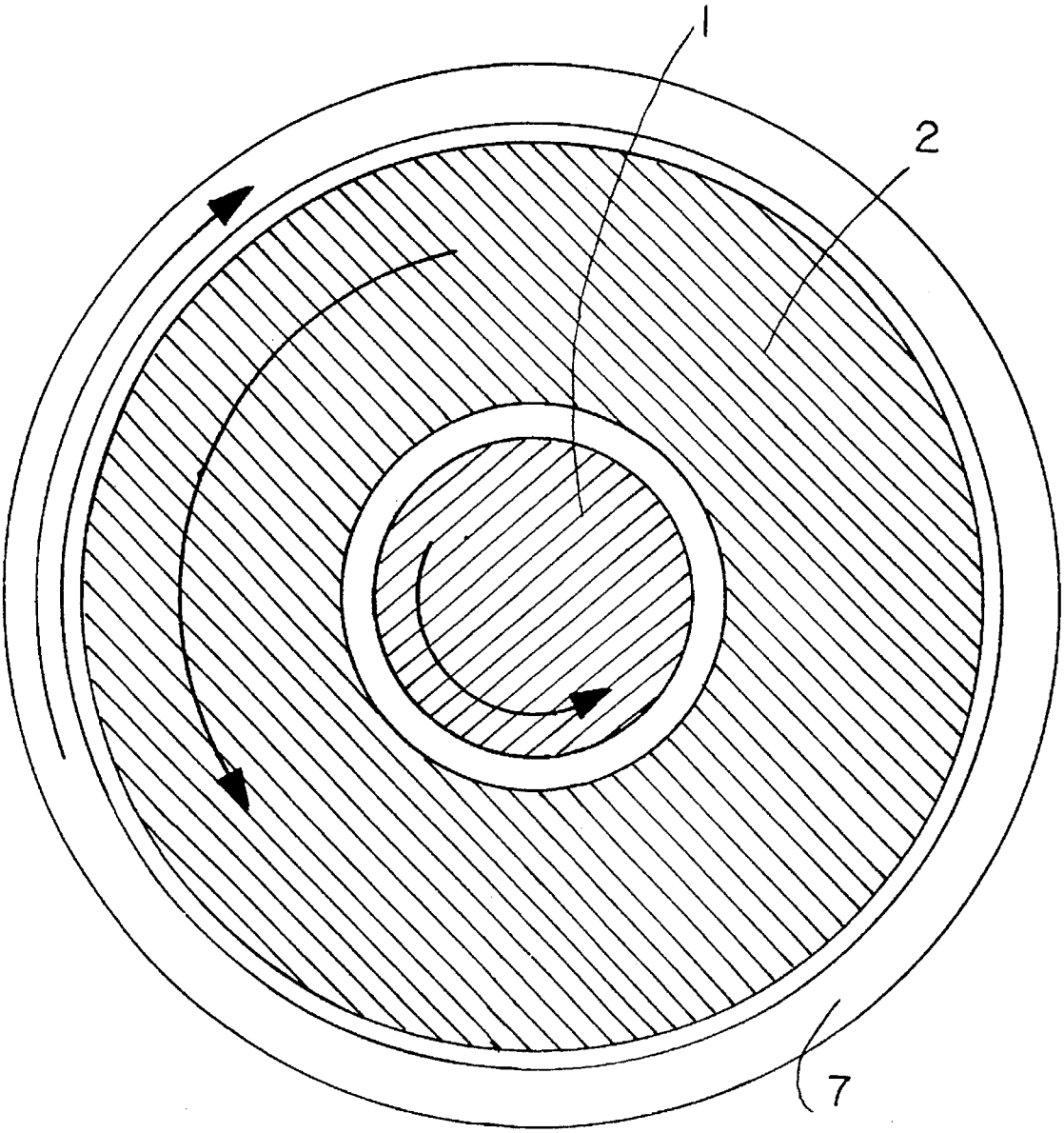
FIG. 35 is an explanatory view about the action of an electromagnetic force when using the casting sleeve which is continuously conductive.
Figure 36:
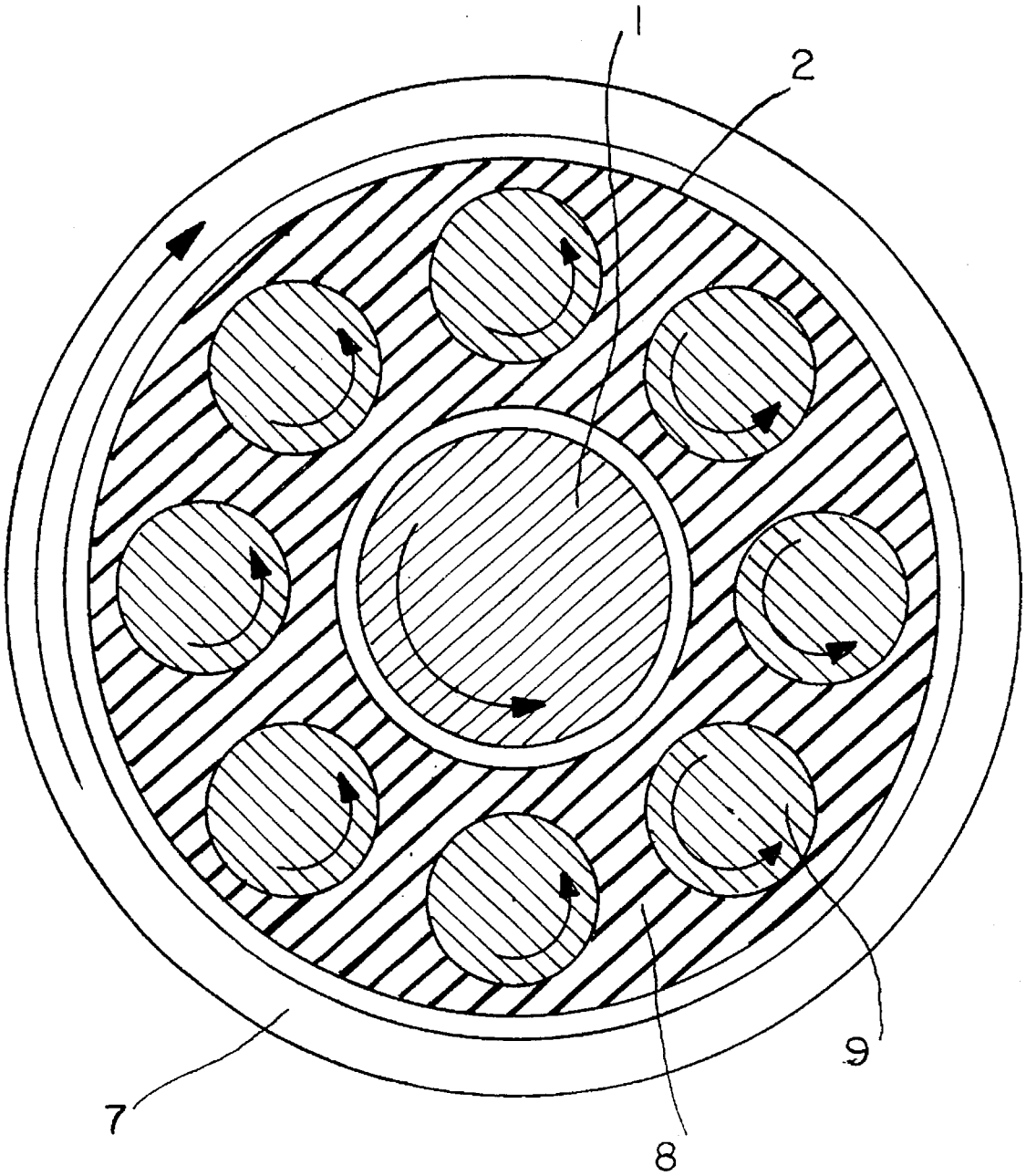
FIG. 36 is an explanatory view about the action of an electromagnetic force when using a plurality of conductors which do not contact mutually.
Figure 37:
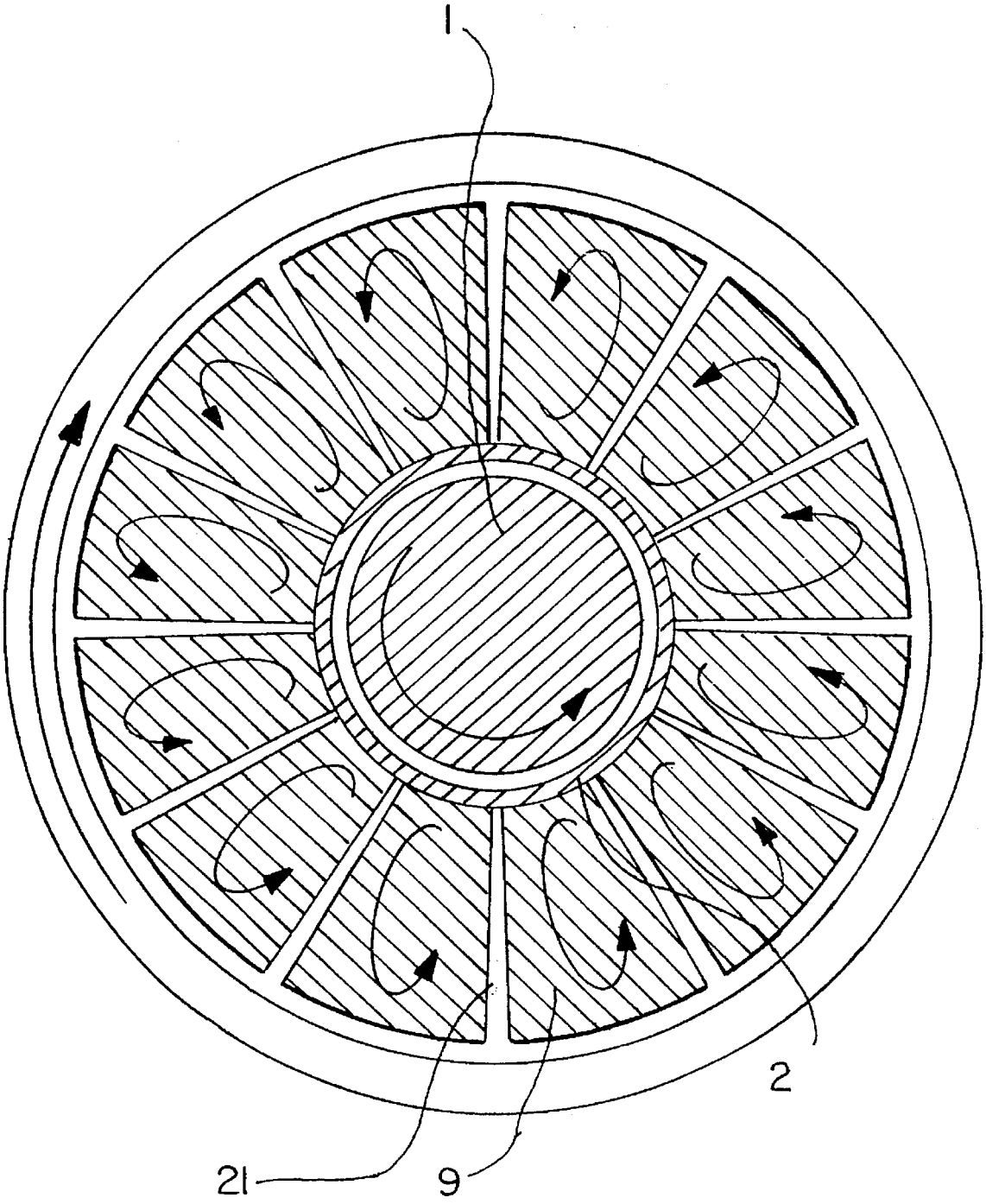
FIG. 37 is an explanatory view about the action of an electromagnetic force when using a conductor having slits formed.
Figure 38:
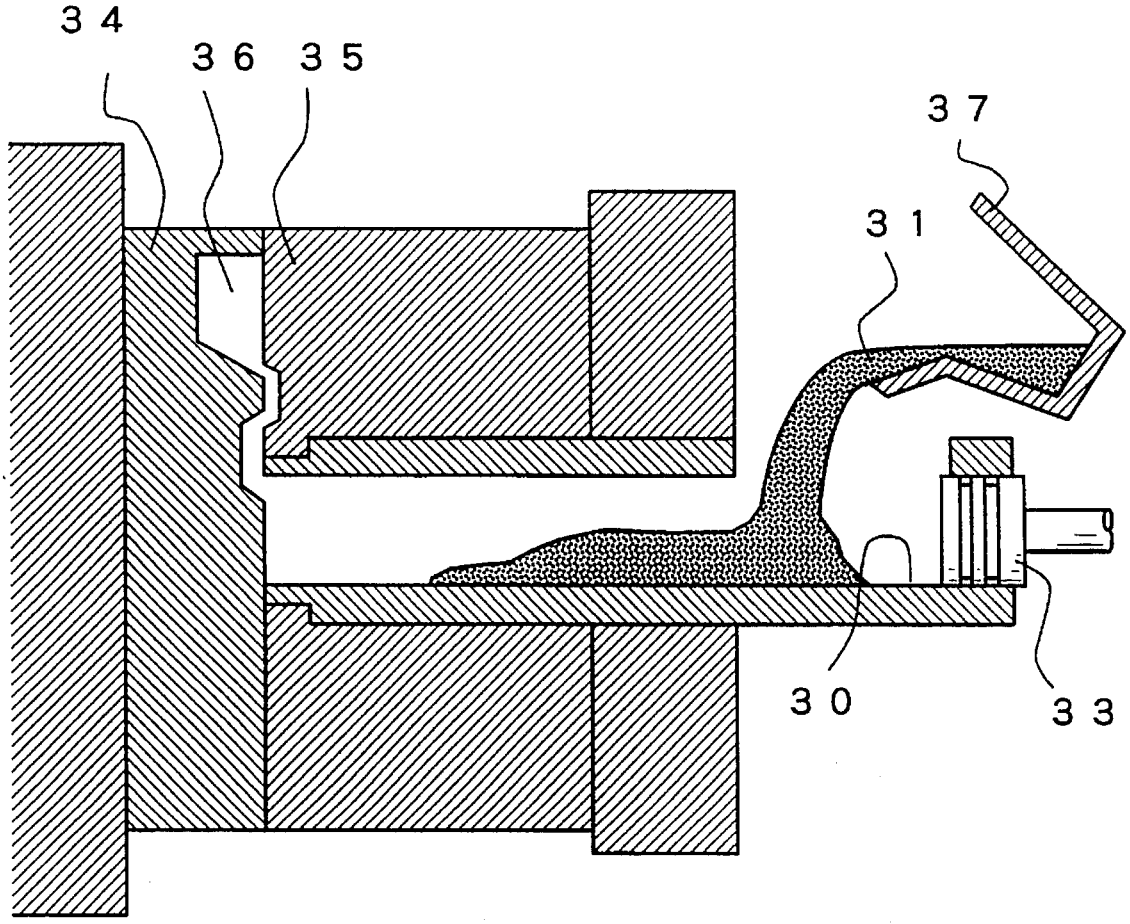
FIG. 38 is a sectional view of a conventional horizontal type die casting machine.
Figure 39:
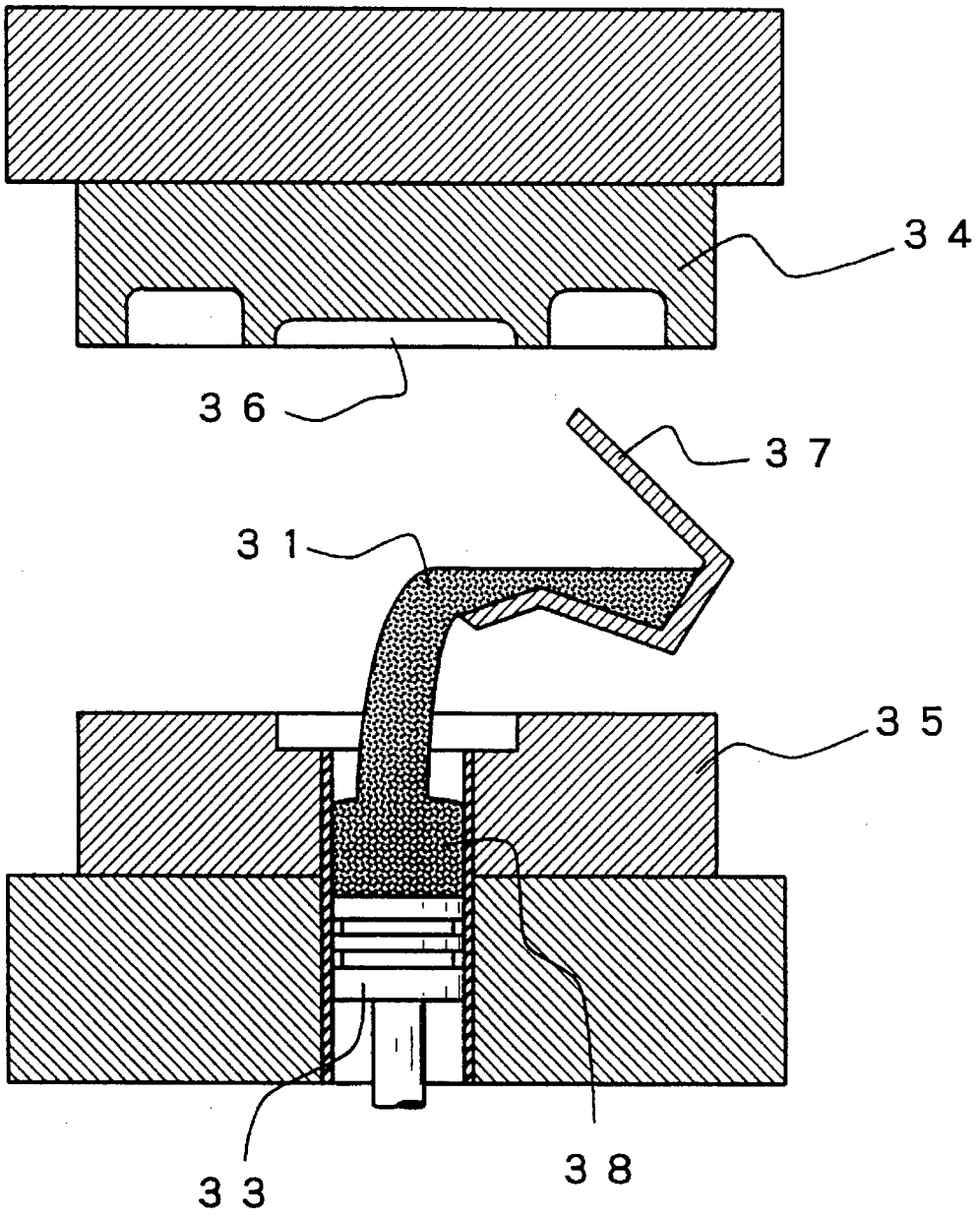
FIG. 39 is a sectional view of a conventional vertical type die casting machine.
Figure 40:
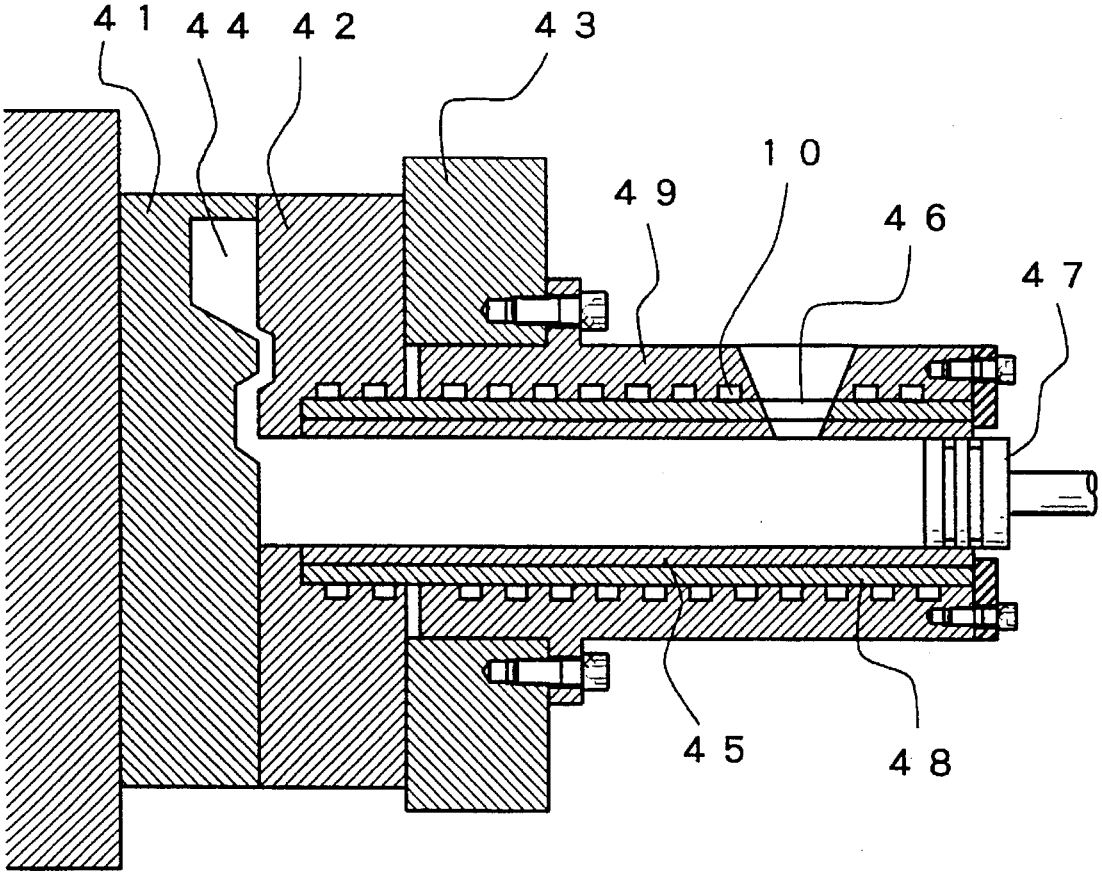
FIG. 40 is a sectional view of a conventional horizontal type die casting machine.
Figure 41:
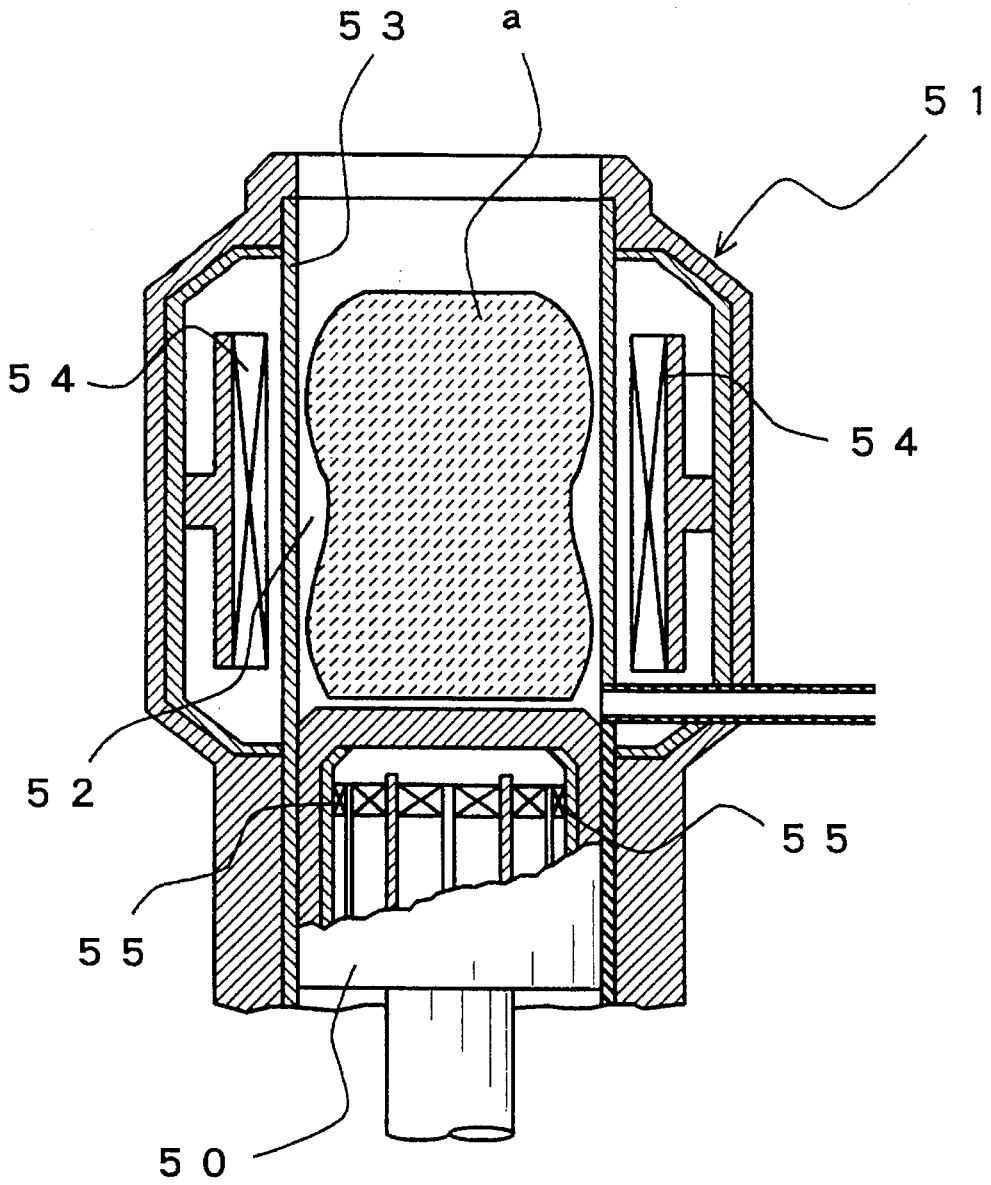
FIG. 41 is a sectional view of a conventional die casting machine heat-insulating the molten metal in a sleeve by an electromagnetic induction.

Referring to FIG. 35 to FIG. 37, the action by an electromagnetic force to prevent the contact of the material to the casting sleeve will be described.

As shown in FIG. 35, when a material 1 to be cast is put in a casting sleeve 2 which is continuously conductive and a current (indicated by arrow) is supplied to an induction coil 7, both of the induced currents (indicated by arrows) generated in the casting sleeve 2 and in the material 1 rotate in the same direction. This causes magnetic fields generated in the casting sleeve 2 and in the material 1 to have same direction and no repulsion force is produced between the casting sleeve 2 and the material 1.

On the other hand, as shown in FIG. 36, when the material 1 to be cast is put in the casting sleeve 2 which is formed by enclosing the periphery of a plurality of conductors 9 by an insulator 8 so as to separate each conductors 9 and an a.c. (indicated by arrows) is supplied to the induction coil 7, induced currents (indicated by arrows) generated in the material 1 and the conductors 9 rotate as facing each other resulting in the generation of a repulsion force between the material 1 and the conductors 9. By this repulsion force, the material 1 does not come into contact with the inner surface of the casting sleeve 2. Since magnetic fields generated at a plurality of conductors 9 directly affect the material 1 to make the induced current flow in the material 1, the material 1 can be heated by the electromagnetic induction even if the casting sleeve 2 is cooled so as to maintain its machine accuracy.

Similarly, as shown in FIG. 37, when the material 1 to be cast is put in an insulating casting sleeve 2 disposed within the conductor 9 having slits 21 and an a.c. is supplied to the induction coil, induced currents generated in the material 1 and the conductor 9 rotate as facing each other resulting in generation of repulsion force between the material 1 and the conductors 9. By this repulsion force (electromagnetic force), the material 1 is kept away from the inner surface of the casting sleeve 2. Since magnetic fields generated at the conductor 9 directly affect the material 1 to make the induced current flow in the material 1, the material 1 can be heated by the electromagnetic induction even if the casting sleeve 2 is cooled so as to maintain its machine accuracy.

According to this invention, the conductors disposed around the material cause generation of heat by electromagnetic induction to make at least the surface of the material flowable. Since an eddy current generated by the electromagnetic induction extends from the surface of conductors, it is possible to melt the material surface only and it is also possible to make the material entirely into a flowable state. As the present methods can directly transmit a magnetic field of the coil to the material within the sleeve via the conductors, the material can be heated effectively. The electromagnetic force generated by the currents flowing in the material and the conductors make it possible to keep the material away from the inner wall of the casting sleeve. The conductors may be partly connected if the above effects are not deteriorated.

Fluidity of cast material is made better as its temperature increases in the semi solid state. In conventional die casting, however, when a liquid phase of a prescribed amount or more is present in the material as a result of heating, maldistribution of a flowable state occurs causing the material to adhere to the wall of the casting sleeve resulting in a temperature drop of the material and the lowering of its fluidity due to the increase of the solid phase. Thus, a poor run of the casting and casting defects are caused in the product, unless the heating temperature is limited to a range that the material is not partially melted. In the methods of this invention, on the contrary, even if partial melting occurs in a material, its adhesion to the wall surface is prevented by the effect of the electromagnetic force, avoiding the temperature drop and the lowering of the fluidity of the material. Heating of the material can be conducted in a relatively broader conditions as a result. Therefore, a thin and long product can be cast.

The material can be prevented from being oxidized and its temperature can be controlled to keep a semi solid state by introducing inert gas such as argon gas or nitrogen gas into the casting sleeve or by decompressing the sleeve interior from the cavity side. Thus, superior products can be obtained without applying a special surface layer removing method to the material.

The invention will now be illustrated in greater detail with reference to the following specific examples and embodiments, but the present invention is not to be construed as being limited thereto.

EXAMPLE 1

Figure 2:
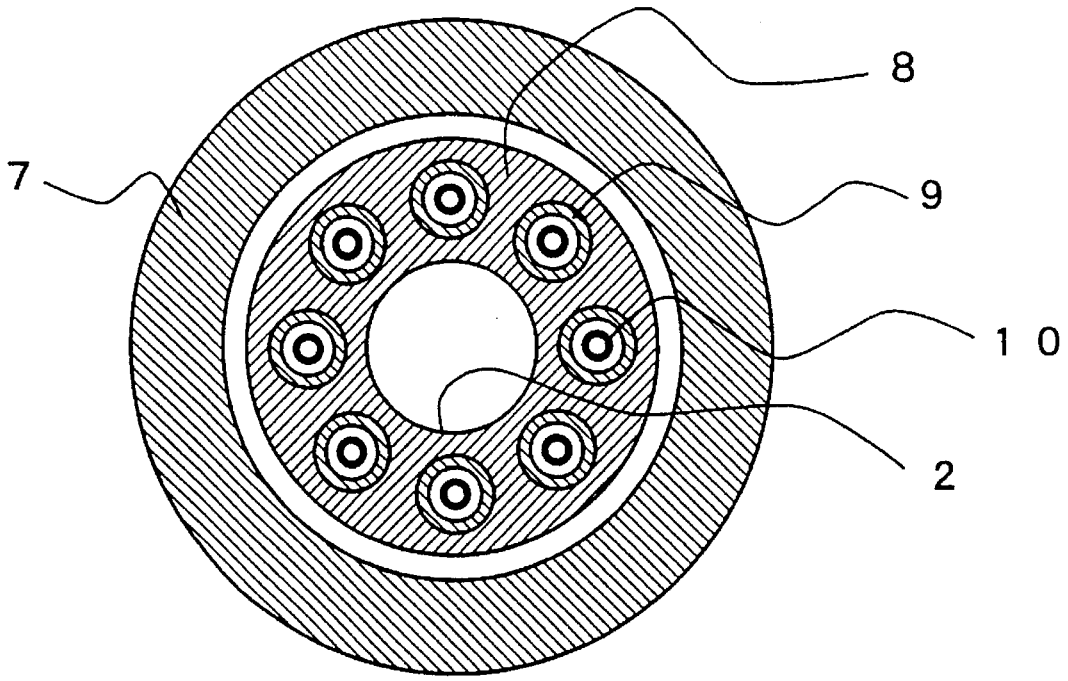
FIG. 2 is a sectional view taken on line A—A of FIG. 1.
Figure 3:
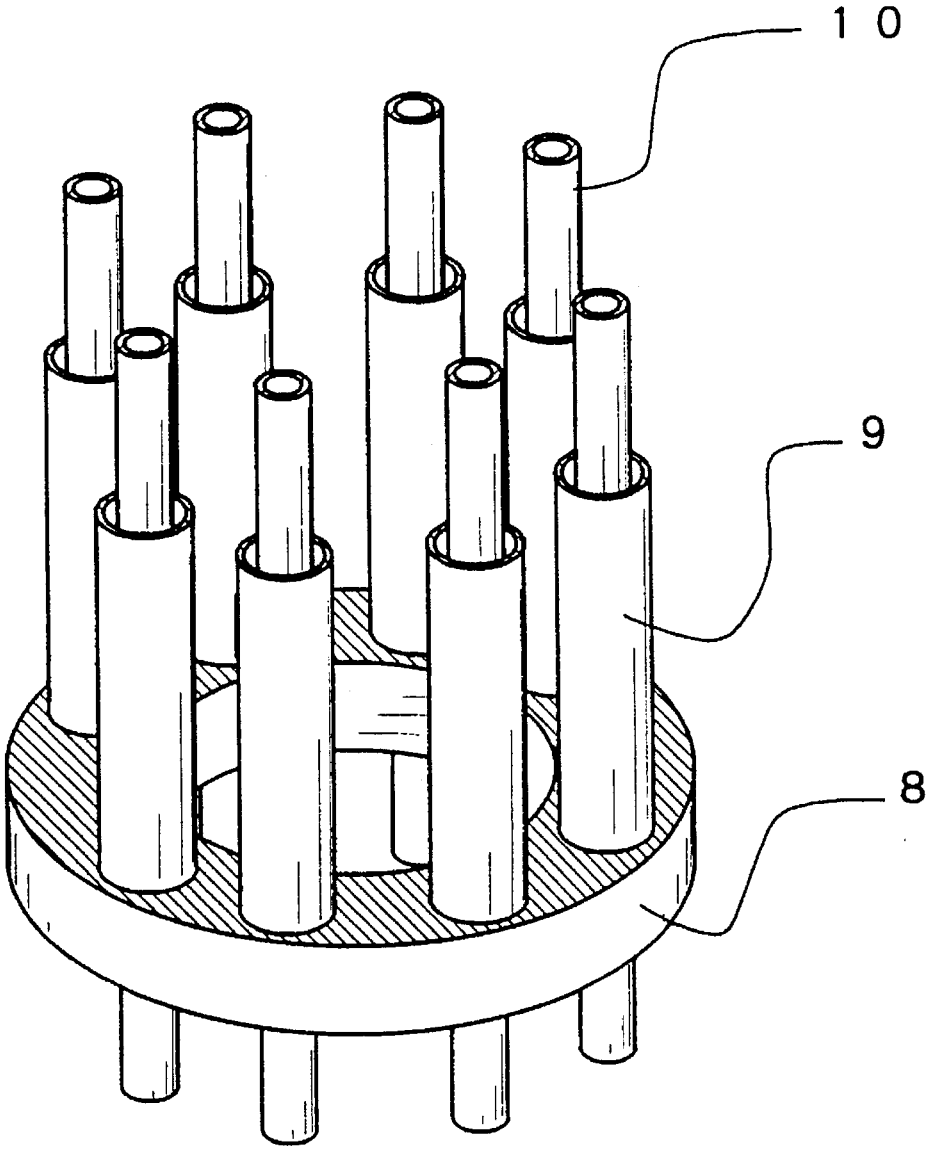
FIG. 3 is a perspective view showing one example of the structure of conductors according to the invention.
Figure 4:
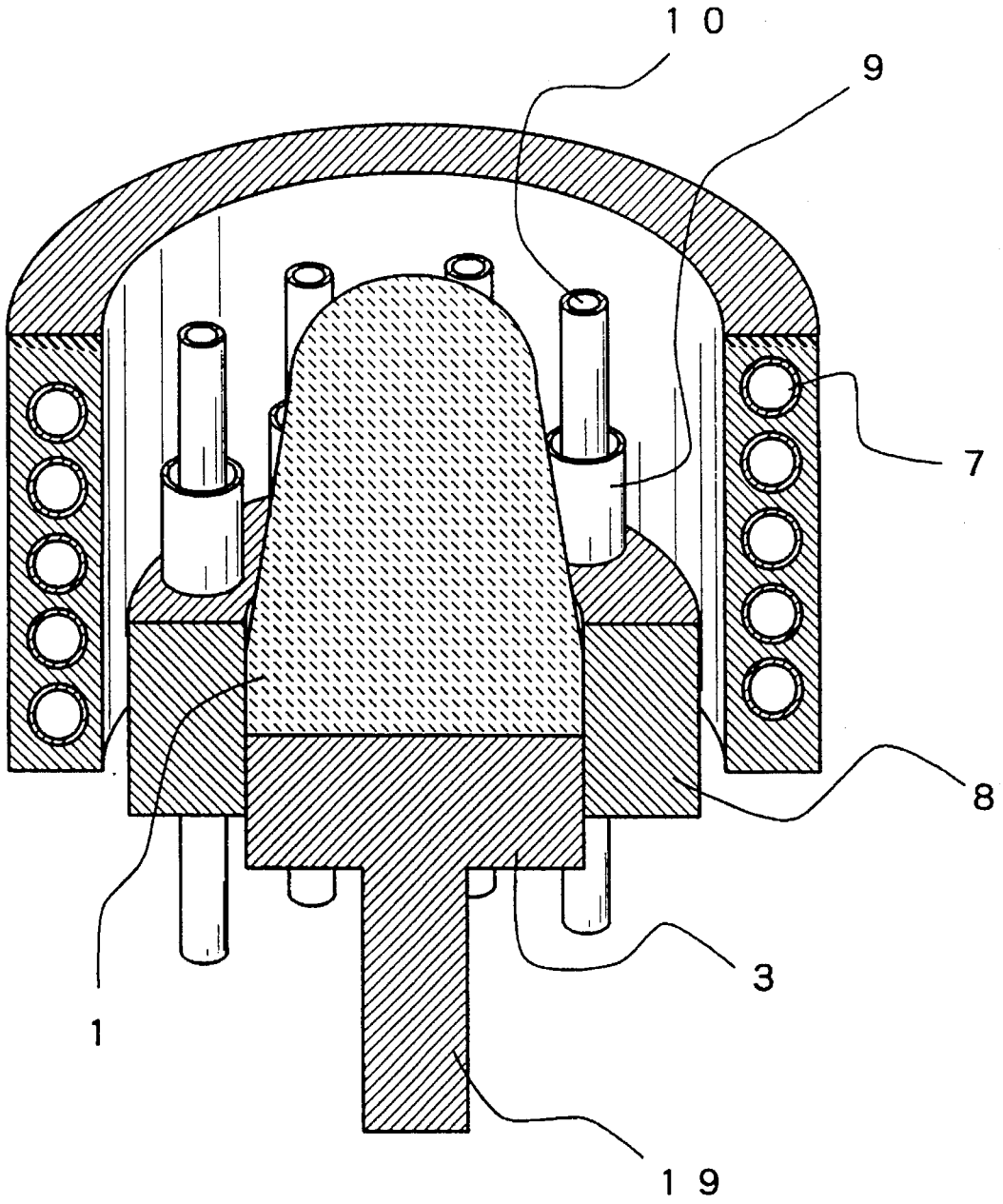
FIG. 4 is a sectional diagram of a semi solid material in a casting sleeve according to the invention.

FIG. 1 shows a vertical sectional view of the vertical type die casting machine (clamping force of 50 tons) according to one embodiment of the invention. To heat a material to be cast 1, an induced current is generated in the material 1 by an induction coil 7 via conductors 9 disposed intermittently in the circumferential direction of a casting sleeve 2. As shown in FIG. 2 which is a view taken on line A—A of FIG. 1, the conductors 9 have their peripheries enclosed by an insulator 8 and are cooled with water in cooling water pipes 10 passing through the interior of the conductors 9. Air cooling may be used instead of the water cooling. FIG. 3 is a perspective view showing the structure of the conductors 9 and FIG. 4 is a sectional view of the structures of the conductors 9 and the induction coil 7. An austenite stainless steel pipe whose interior is cooled with water is embedded in a ceramic material, whose outside is wound by 5 turns of a water-cooled copper coil. A current applied to the coil 7 is about 500 A and has a frequency of 20 kHz. The sleeve has an inner diameter of 50 mm and an outer diameter of 80 mm. A cylindrical aluminum alloy material made from an aluminum alloy known as AC4CH which was vigorously stirred when solidified is inserted to cast a plate of 50 mm wide, 100 mm long and 3 mm thick. A gate velocity is 10 m/sec, and an applied pressure is 90 MPa.

Figure 5:
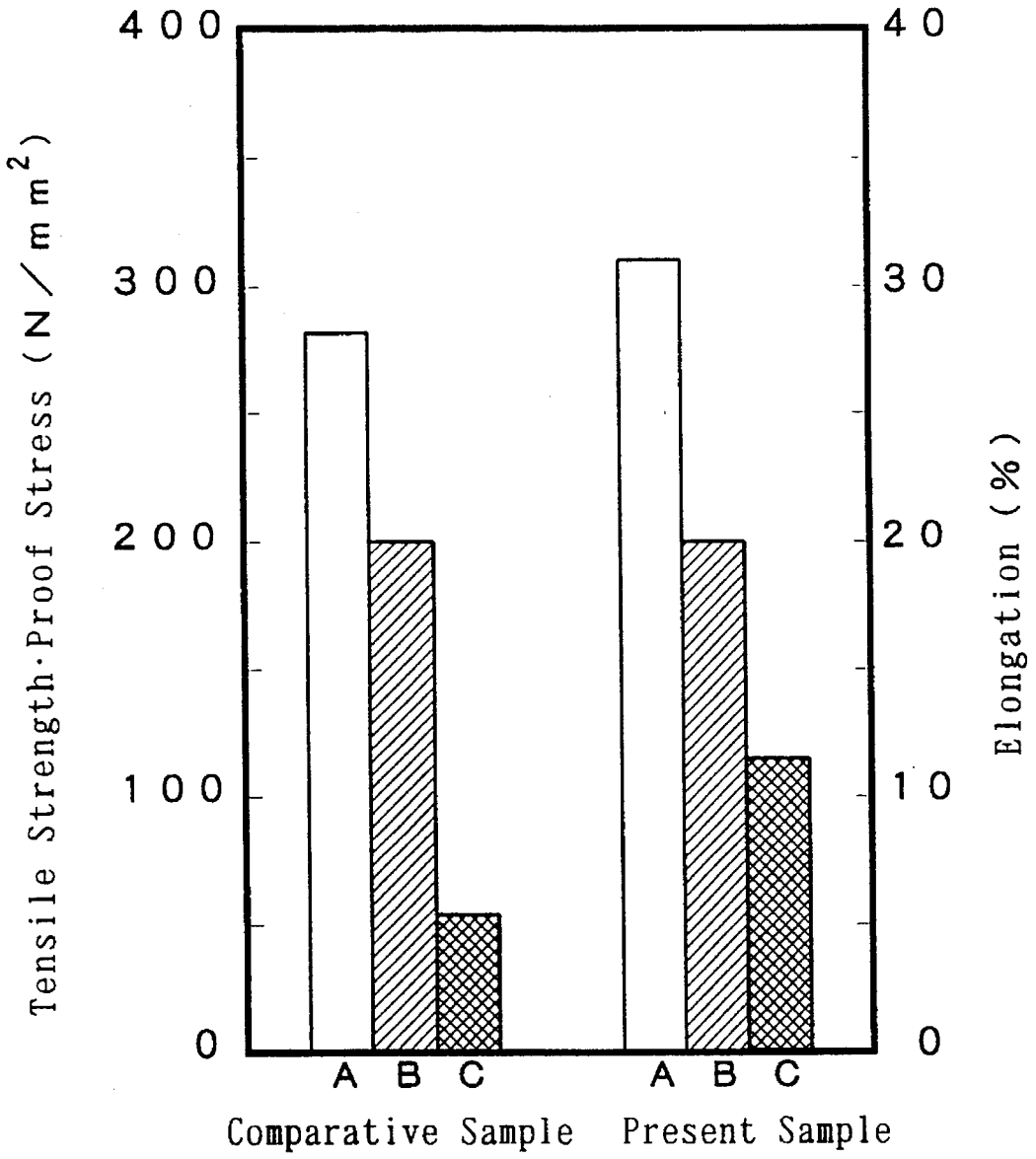
FIG. 5 is a graph showing the comparison results of mechanical properties of cast products produced by the invention and a prior art.
Figure 6:
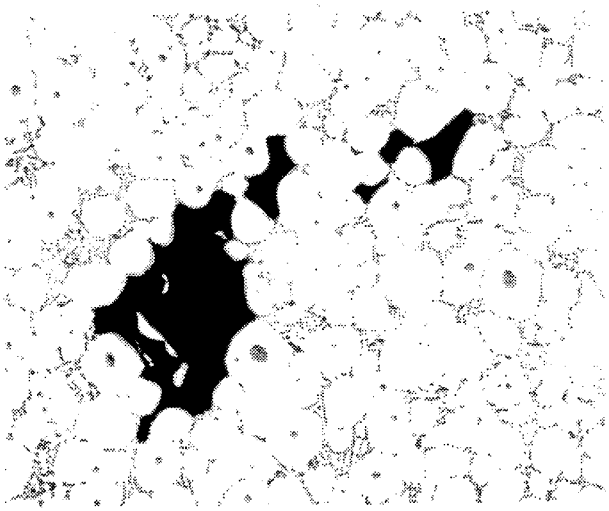
FIG. 6 is a microphotograph (50x magnification) of a cast product structure produced by a conventional method.
Figure 7:
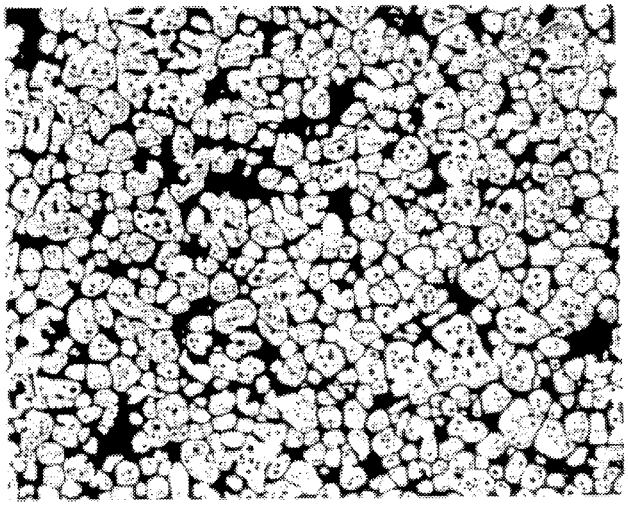
FIG. 7 is a microphotograph (50x magnification) of a cast product structure produced by a method according to the invention.

According to the method of this invention, a semi solid material 1 in the casting sleeve has a shape as shown in FIG. 4 and does not contact with the casting sleeve excepting its bottom. Temperature is controlled to 590° C. +/–5° C. by induction heating and cooling gas, and induction stirring is conducted prior to pressure die casting. The casting sleeve has substantially the same temperature of about 250° C. as in prior art. The mechanical properties of the products cast by the present method and a conventional re-heating method (conventional sample) are compared. As shown in FIG. 5, the product according to the method of this invention is superior in tensile strength (A) and elongation (C). FIG. 6 (conventional sample) and FIG. 7 (present sample) are microphotograph (50x magnifications) showing metallic structure of the products. Since good fluidity of the material is provided in the present invention, a product without casting defect is obtained. On the other hand, as the conventional method has poor fluidity, the material can not be fed sufficiently, causing defects (black massive parts in FIG. 6).

EXAMPLE 2

Figure 8:
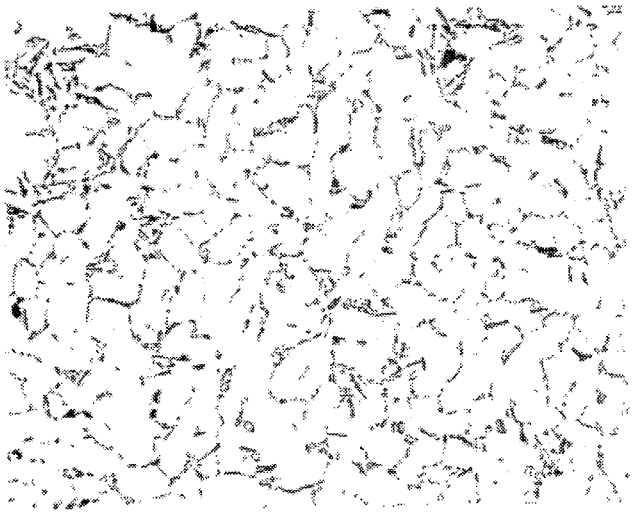
FIG. 8 is a microphotograph of a material structure processed by a method according to the invention.

A cylindrical aluminum alloy material known as AC4CH is inserted in the machine of FIG. 1 (clamping force of 100 tons) and heated to 590° C. A current applied to the coil 7 is about 30 kW and has a frequency of 10 kHz. The shape of the material in the sleeve is deformed to be the semi solid body 1 as shown in FIG. 4, and fluidity in the material is caused. At this point, heating is stopped, the material is cooled and its structure is examined. The results are shown in FIG. 8 (a microphotograph of the structure, 50x magnification).

Figure 9:
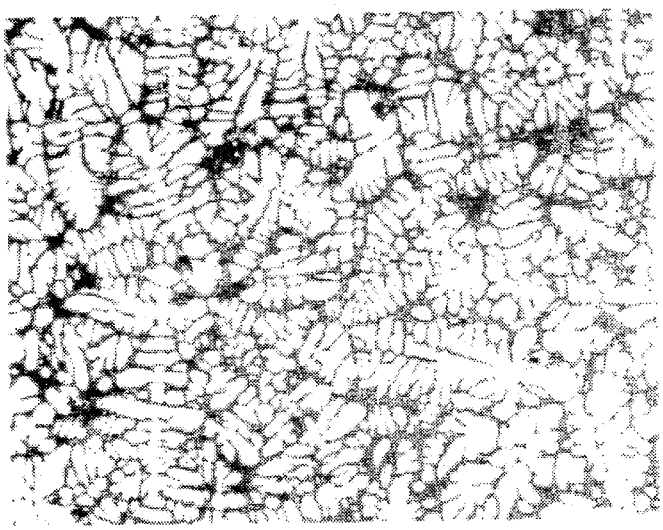
FIG. 9 is a microphotograph of a material structure before heat treatment.

For comparison, FIG. 9 shows a microphotograph of the structure of the material before heating (50x magnification). The material without heating clearly shows dendrite structure but in the material heated by the method of this invention, the dendrite structure is degenerated into a granular structure.

EXAMPLE 3

Figure 10:
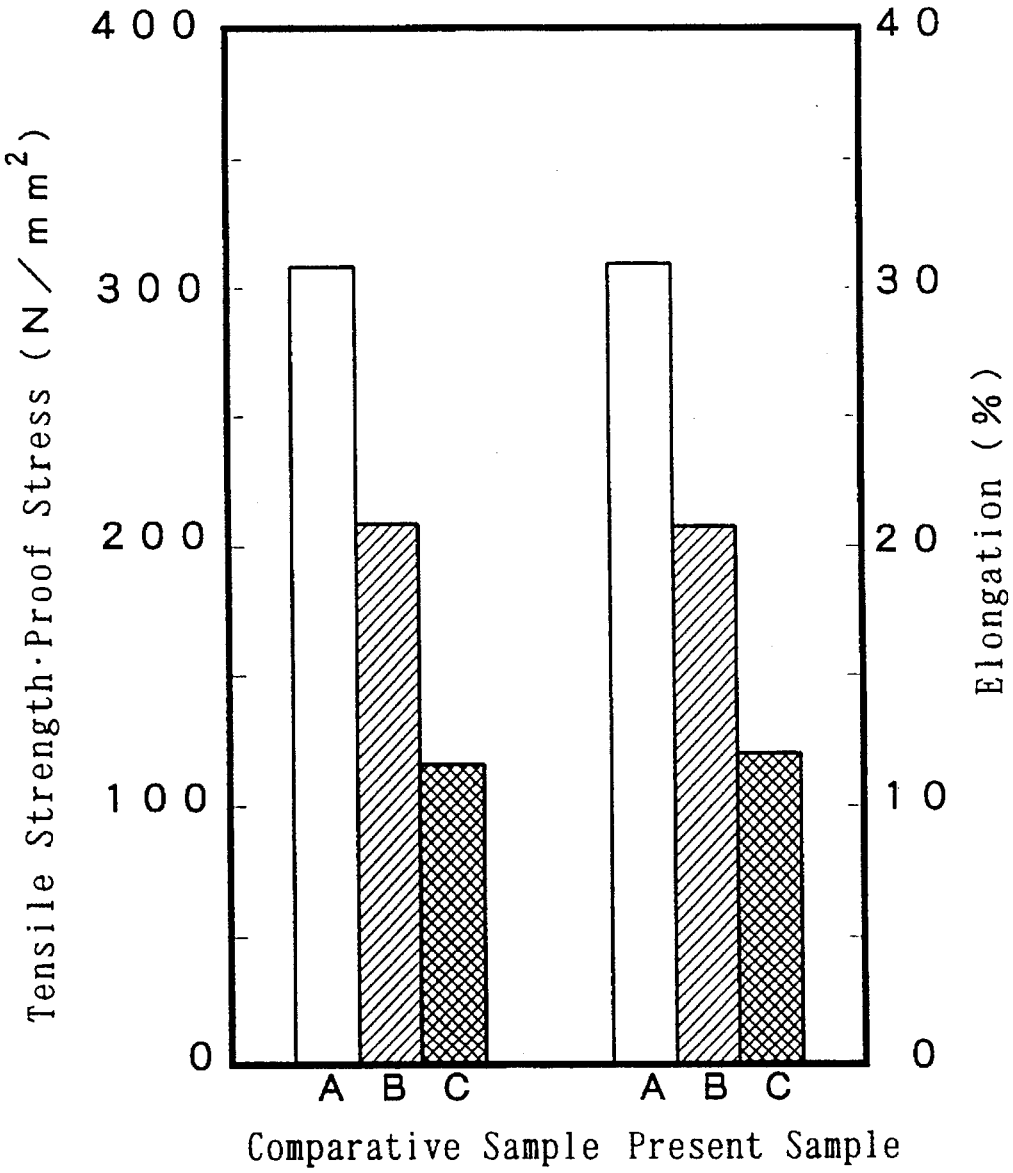
FIG. 10 is a graph showing the comparison results of mechanical properties of cast products produced according to the invention and a prior art.

A pre-stirred AC4CH material obtained by electromagnetic stirring and an AC4CH material containing the dendrite structure are prepared. The material containing dendrite is heated to 590° C. +/–2° C. under the same conditions as in Example 2 and cast into a plate of 70 mm wide, 150 mm long and 3 mm thick. A gate velocity is 10 m/sec and an applied pressure is 90 MPa. The pre-stirred material is also cast into a plate of 70 mm wide, 150 mm long and 3 mm thick by a conventional re-heating method. Each product is subjected to the standard tempering process known as T6 and examined for mechanical properties. As a result, the product made from the material containing dendrite according to this invention has good properties similar to those of the comparative sample made of the pre-stirred material as shown in FIG. 10. In FIG. 10, (A) shows tensile strength, (B) proof stress, and (C) elongation.

Figure 11:
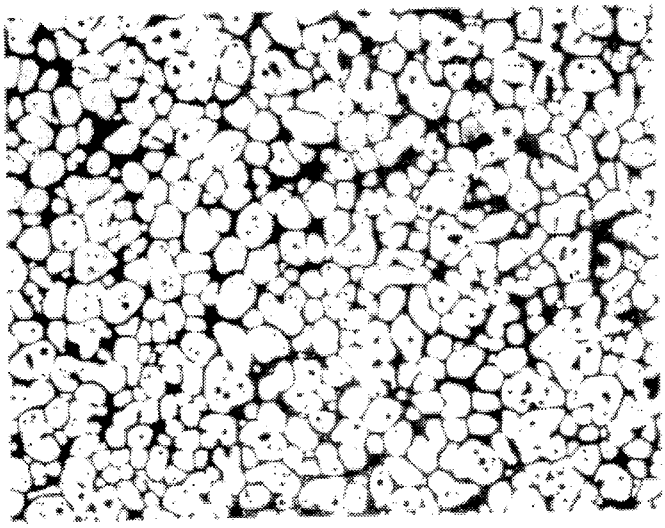
FIG. 11 is a microphotograph of a tempered cast product structure prepared according to the invention.
Figure 12:
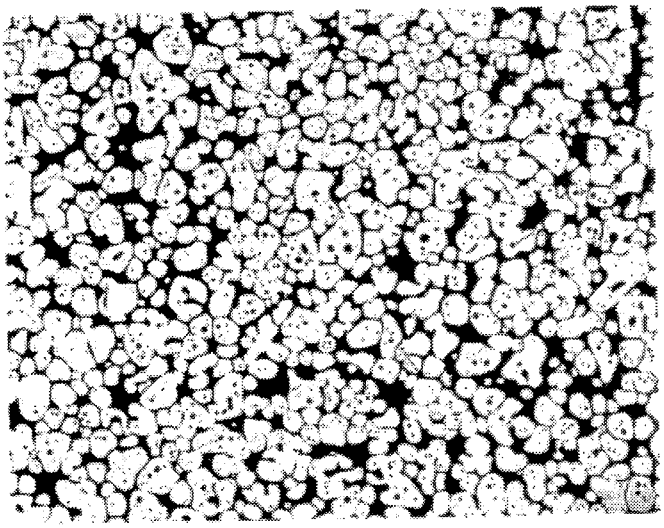
FIG. 12 is a microphotograph of a tempered cast product structure prepared according to a conventional method.

FIG. 11 shows a microphotograph of the structure after tempering by the standard T6 heat treatment process of the product according to this invention and FIG. 12 shows a microphotograph of the structure after tempering by the standard T6 heat treatment process of the product according to the conventional method. The product according to the present invention has uniform granular structure.

EXAMPLE 4

Figure 13:
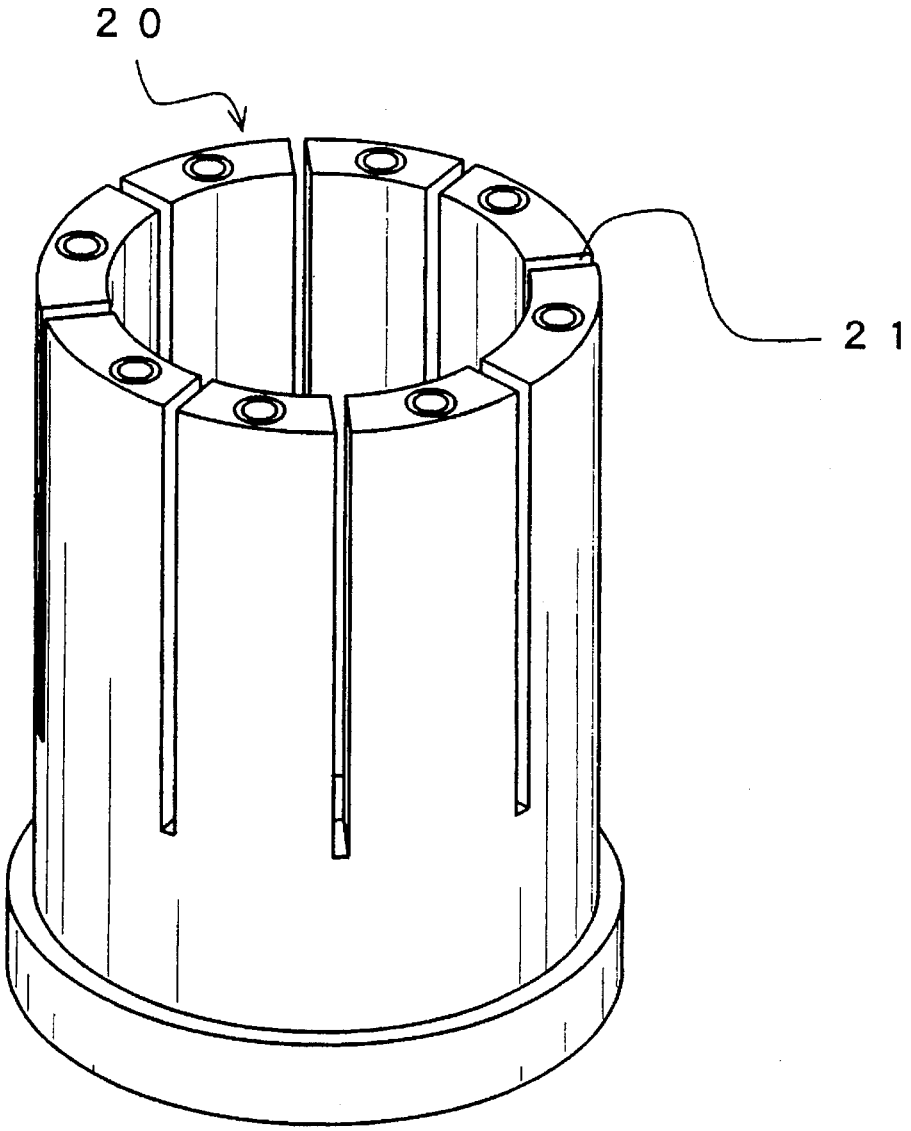
FIG. 13 is a perspective view of another example of the conductor of the invention.
Figure 14:
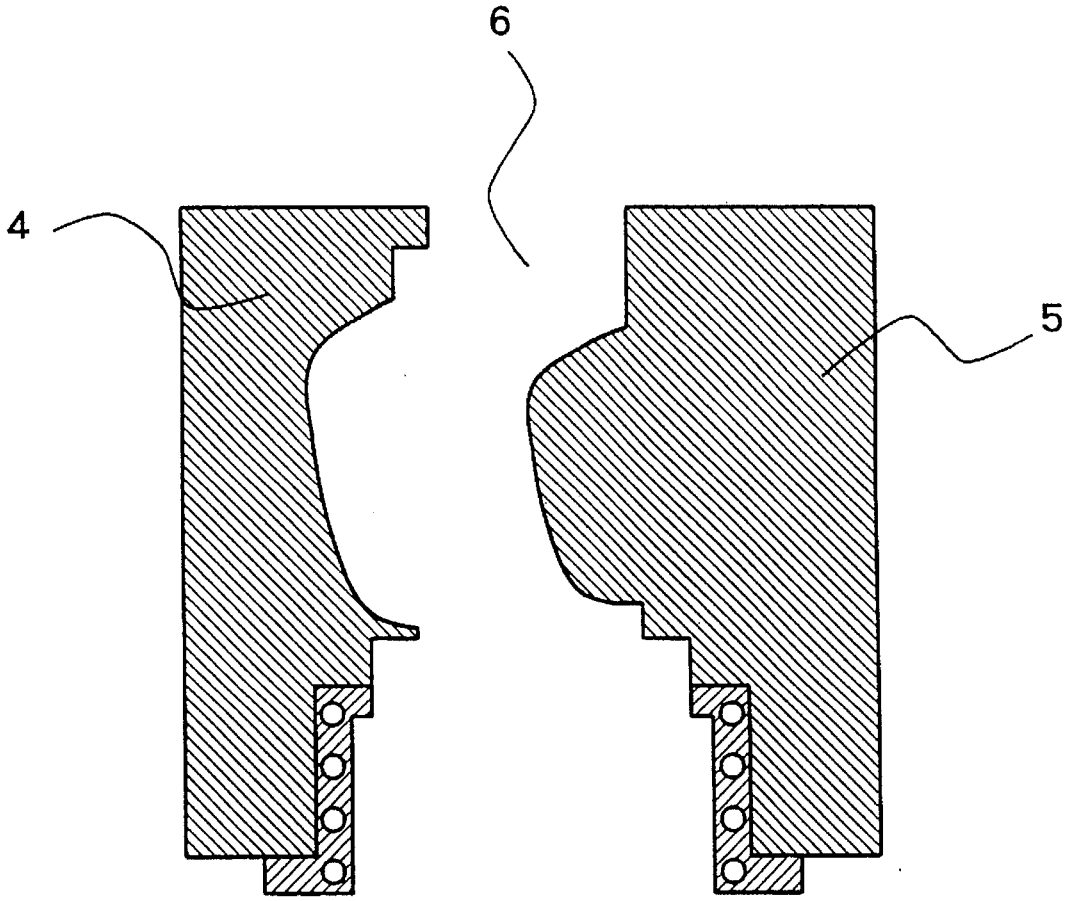
FIG. 14 is a sectional view showing dies of a vertical type die casting machine according to one embodiment of the invention.
Figure 15:
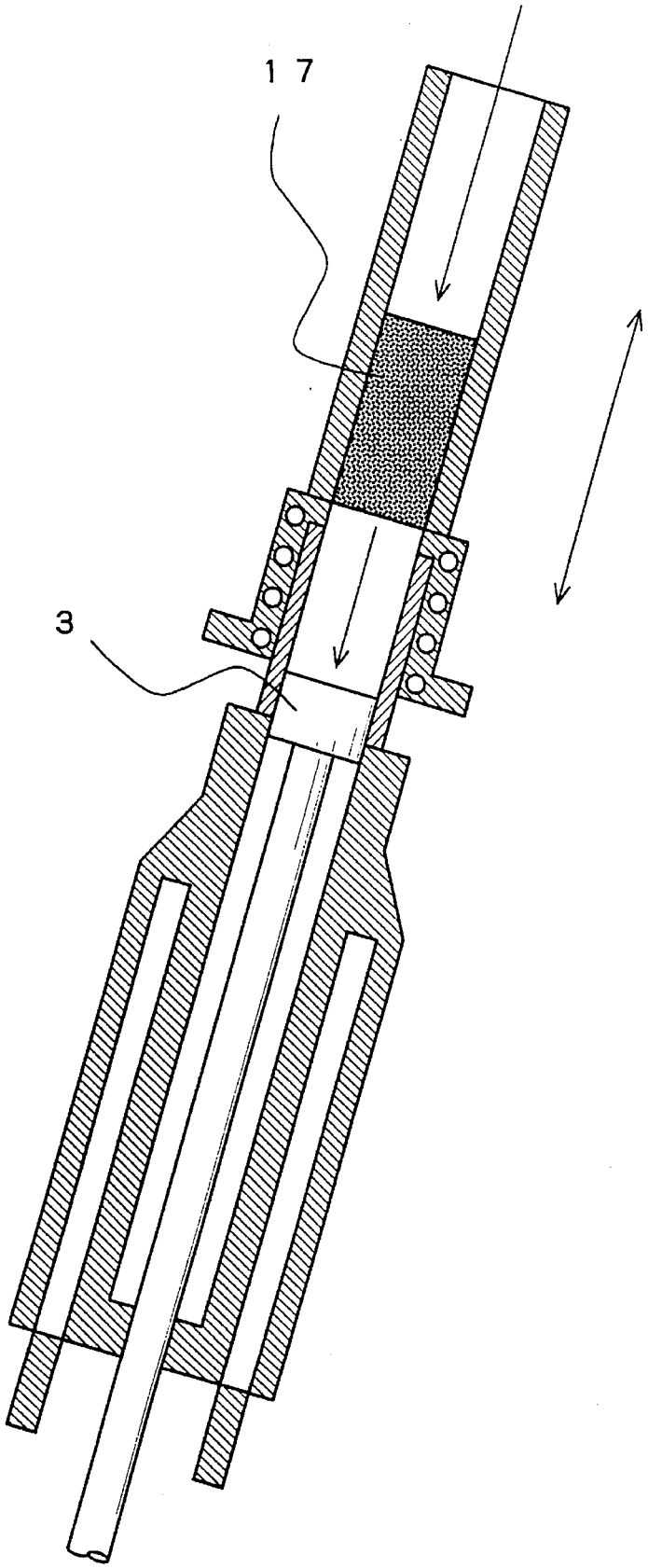
FIG. 15 is a diagram showing that a material is inserted and heated in a casting sleeve according to the invention.
Figure 16:
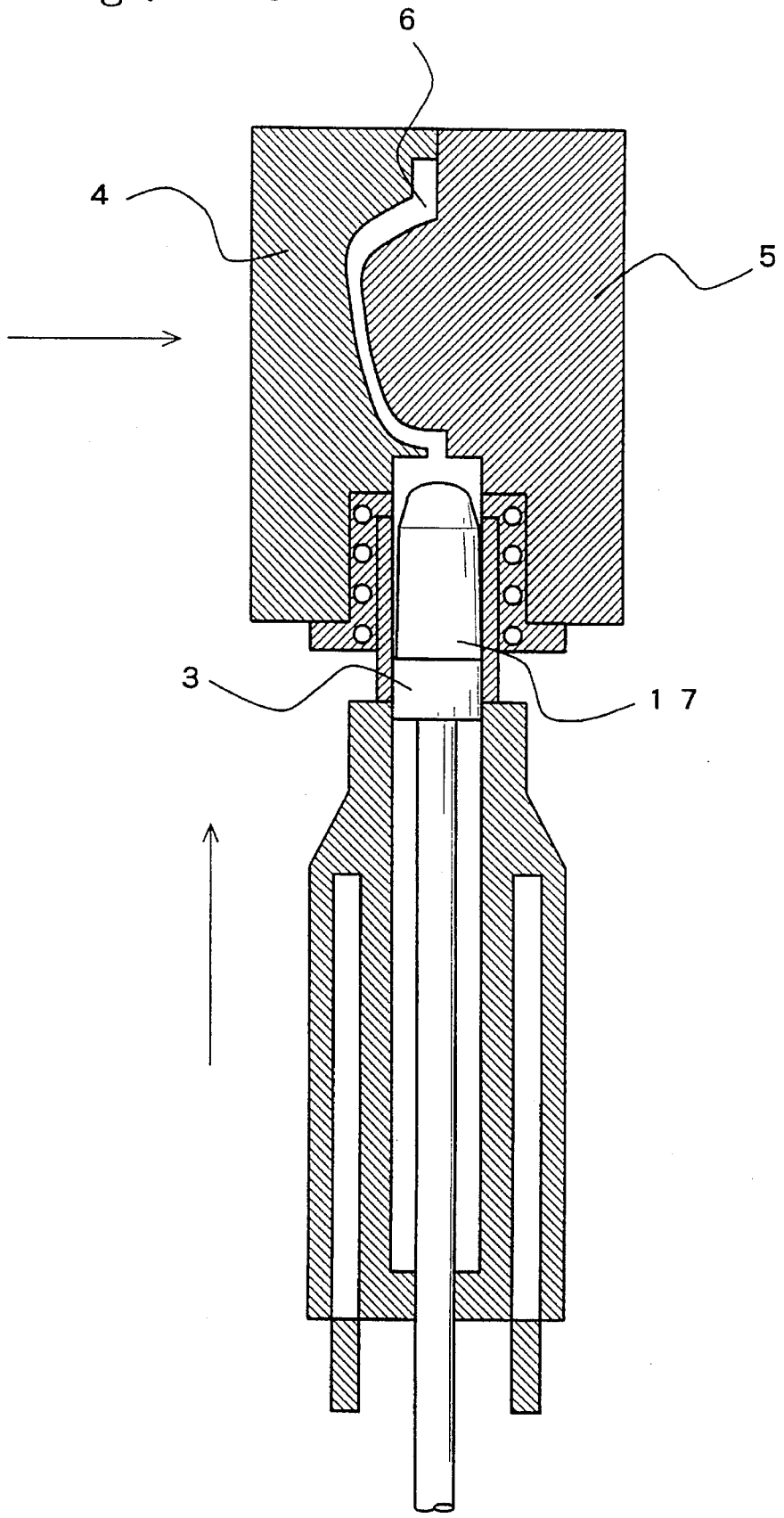
FIG. 16 is a sectional view showing a vertical type die casting machine according to one embodiment of the invention.

FIGS. 13 to 16 show another die casting machine according to the present invention. As shown in FIG. 14, a cavity 6 is formed by a movable die 4 which horizontally opens and closes and a stationary die 5 which is fixed. FIG. 13 shows a sleeve 20 made of a conductor. In sleeve 20, slits 21 are formed and filled with a ceramic material adhesive. A solidified material 17 is inserted into sleeve 20 as shown in FIG. 15 and heated by an induction heating in an atmosphere of argon gas as shown in FIG. 16. Then, it is infected under pressure into cavity 6 of the closed dies for casting.

EXAMPLE 5

Figure 17:
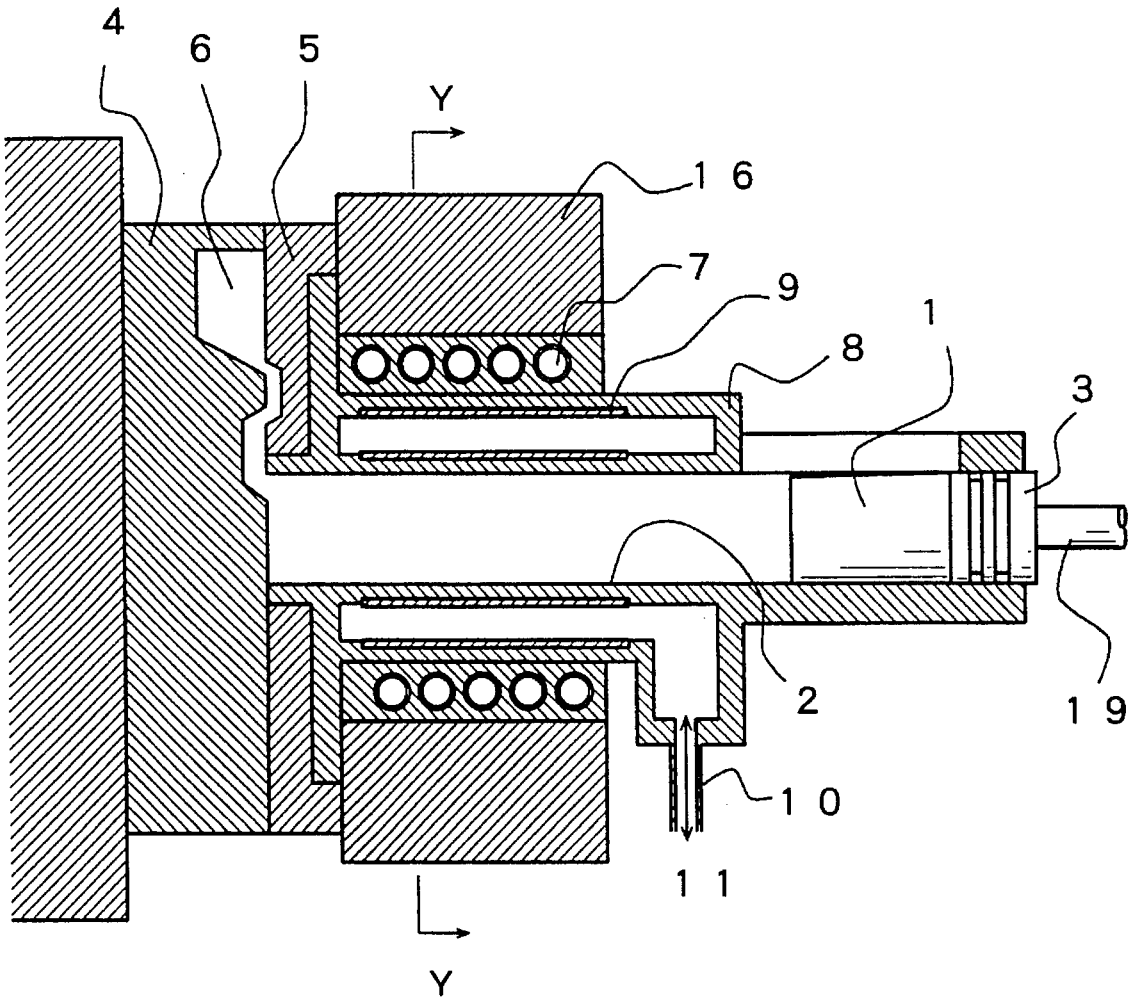
FIG. 17 is a schematic sectional view of a horizontal type die casting machine according to one embodiment of the invention.
Figure 18:
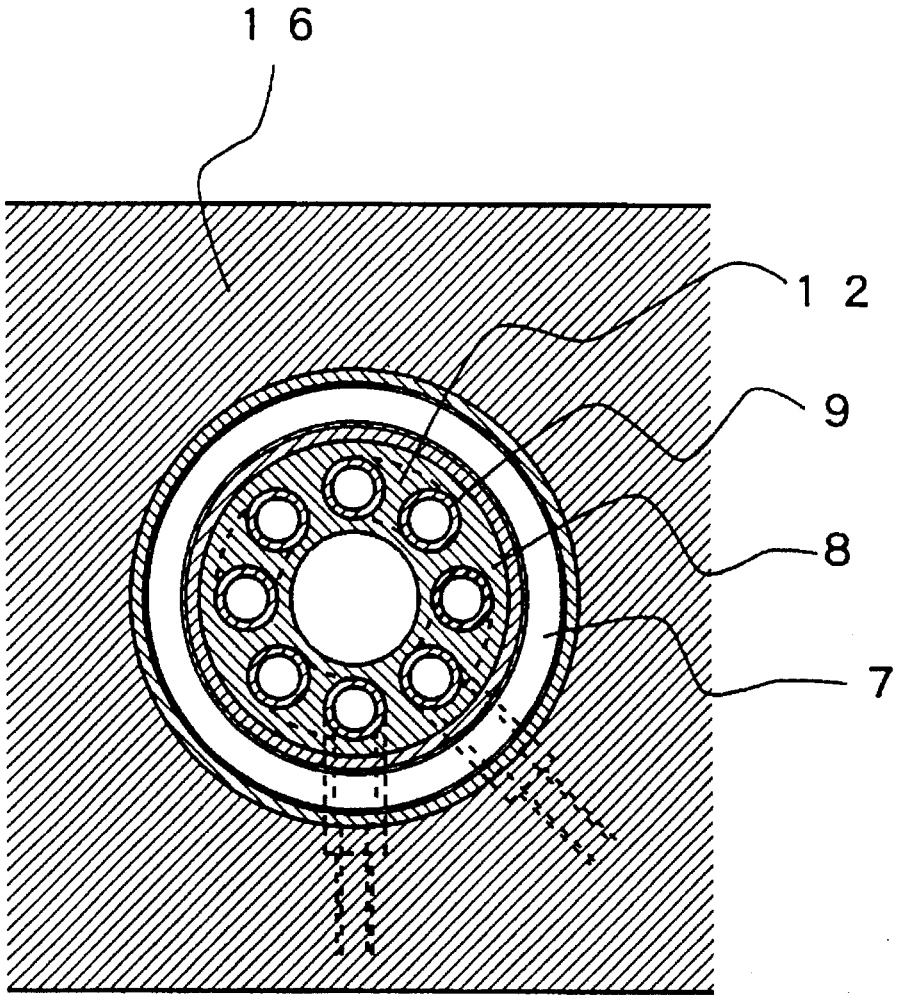
FIG. 18 is a sectional view taken on line Y—Y of FIG. 17.
Figure 19:
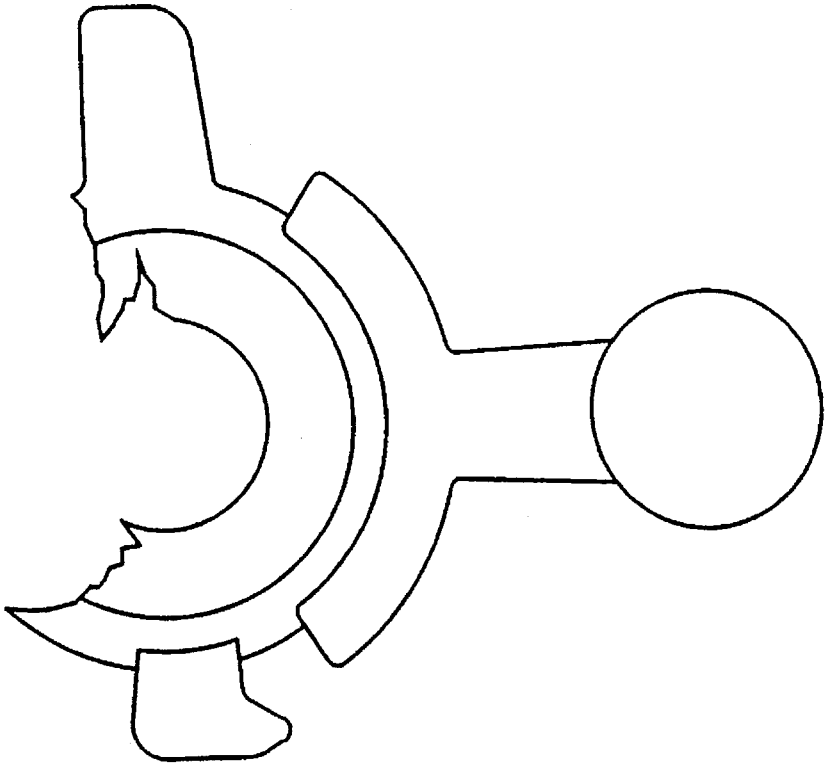
FIG. 19 is a view showing a short run state of a product cast by a conventional method.
Figure 20:
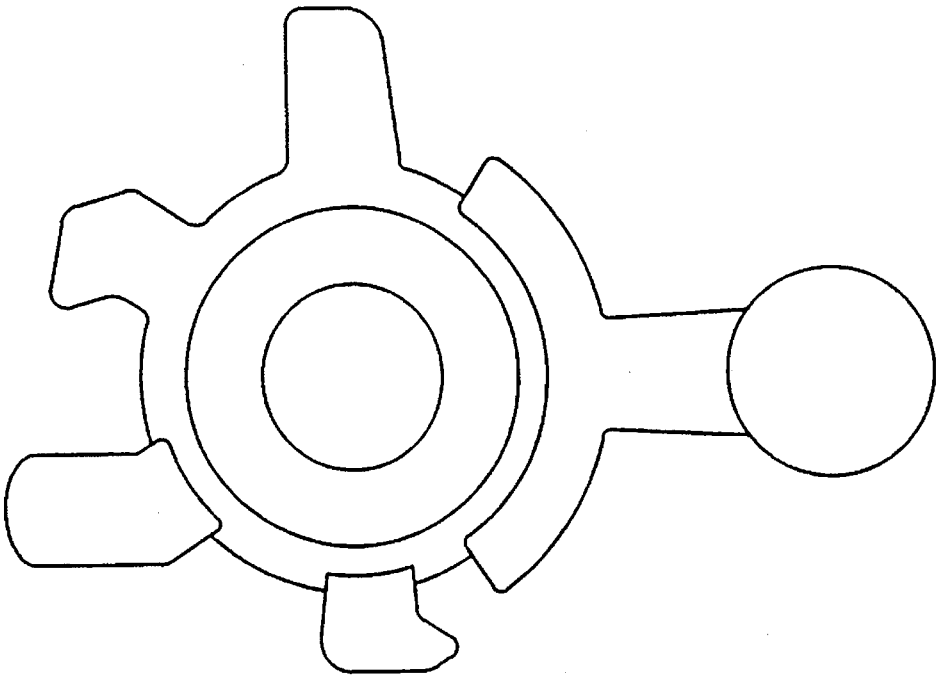
FIG. 20 is a view showing a product cast by a method according to the invention.

FIG. 17 shows a vertical sectional view of a horizontal type die casting machine (clamping force of 350 tons) according to another example of this invention. FIG. 18 is a view taken on line Y—Y of FIG. 17. The conductors 9 have their peripheries enclosed by an insulator 8 and are cooled with water in cooling water pipes 10 passing through the interior of the conductors 9. To heat a material to be cast, an induced current is generated in the material 1 in a sleeve 2 by an induction coil 7 via conductors 9 disposed intermittently in the circumferential direction of the casting sleeve. An AC4CH round bar is heated in the same way as in Example 1 to shape a housing. The other housing which is cast from the same material by a conventional re-heating method suffered from a short run as shown in FIG. 19, but a good product can be produced by the method of this invention as shown in FIG. 20.

EXAMPLE 6

Figure 21:
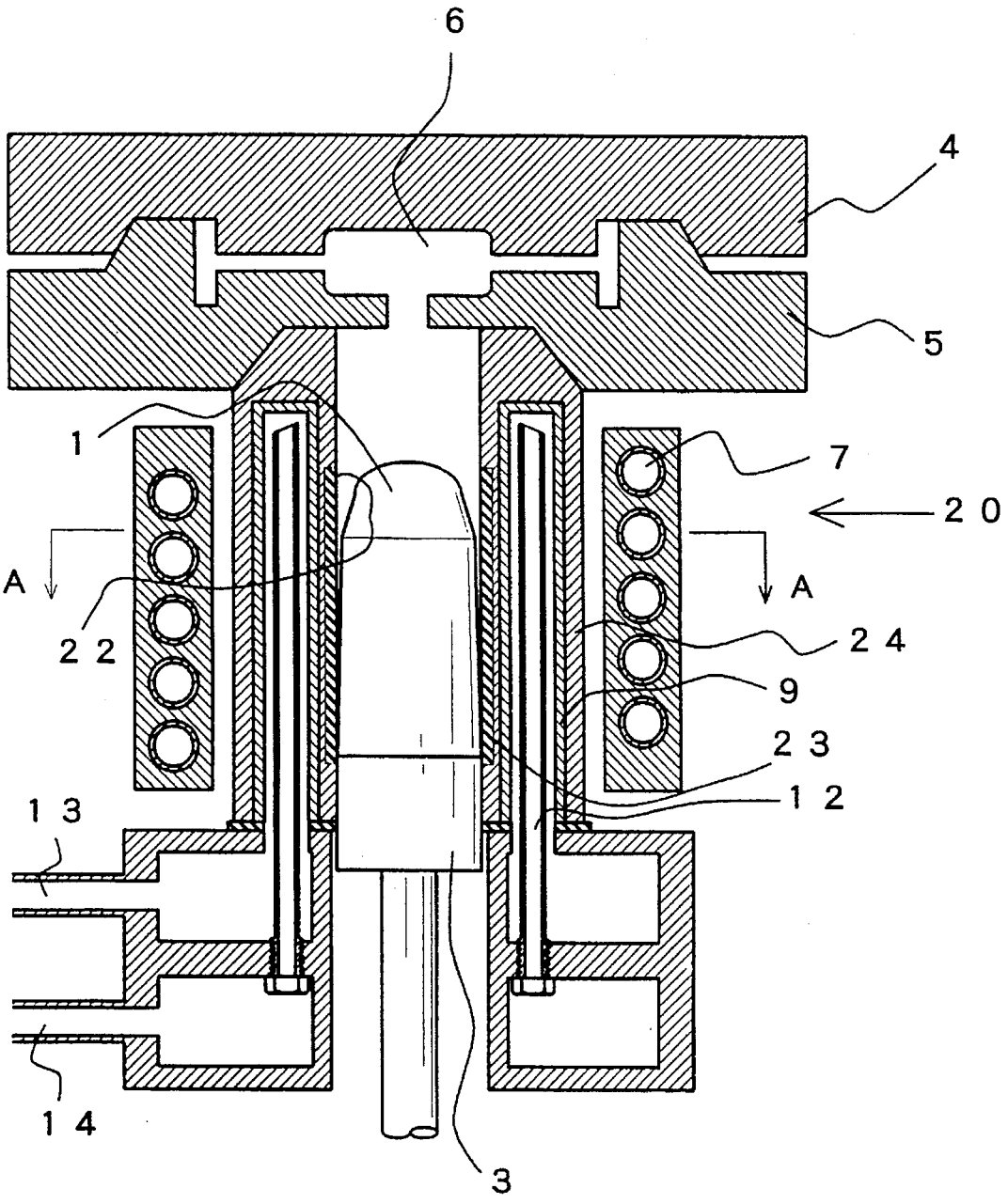
FIG. 21 is a sectional view of a vertical type die casting machine according to one embodiment of the invention.
Figure 22:
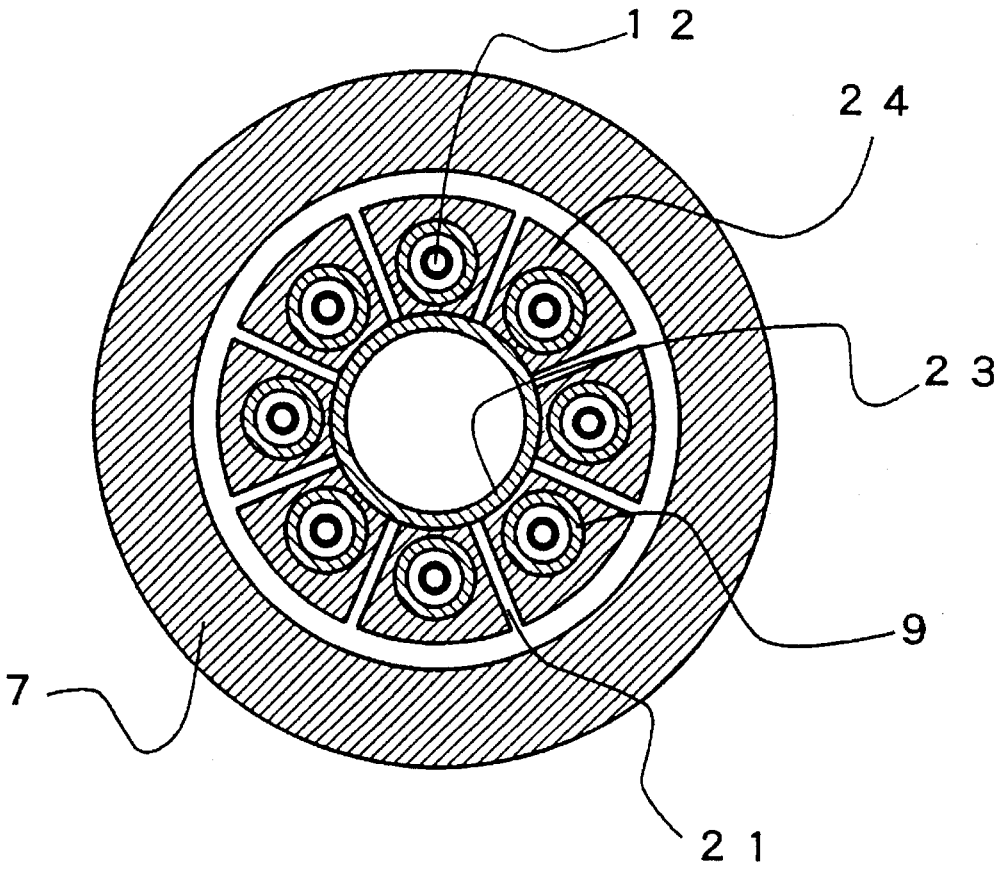
FIG. 22 is a sectional view taken on line A—A of FIG. 21.

FIG. 21 shows a vertical sectional view of a vertical type die casting machine according to another example of the invention and FIG. 22 is a sectional view taken on line A—A of FIG. 21. A casting sleeve 20 comprises an inner cylinder 22 partly made of the ceramic material known as SIALON 23 and an outer cylinder 24 made of a non-magnetic austenite-based stainless steel. Eight slits 21 are formed on the outer cylinder. An induction coil 7 is wound on the outer periphery of the outer cylinder 24, and an induction heating device (not shown) is connected to the induction coil 7. Passages 12 for circulating cooling water are formed in the outer cylinder 24. The induction heating device electrifies the induction coil 7 at a frequency of about 300 to 1000 Hz with a current of about 1000 to 3000 A. The casting sleeve has an inner diameter of 80 mm and an outer diameter of 140 mm. An aluminum alloy material known as A357, in molten form is fed into the sleeve at a feeding temperature of 620° C. to cast a plate of 50 mm wide, 100 mm long and 3 mm thick. The gate velocity is 15 m/sec and the applied pressure is 120 MPa. The atmosphere of the interior of the casting sleeve is replaced by inert gas to suppress the oxidation of the material to be cast.

By the die casting method of this invention, the molten A357 material 1 in the inner cylinder 22 of the casting sleeve is shaped as shown in FIG. 21 and the material 1 has a small contact with the surface of SIALON 23 of the inner cylinder 22 excepting its bottom. This causes a temperature drop of the material to be quite small. In case of a conventional die casting machine, when the molten metal is fed at 630° C., the temperature at the center of the inner cylinder drops 570° C. in 5 seconds. Since the molten metal has a small contact with the casting sleeve 20, a small number of solidified pieces are formed on the surface of the molten metal. Furthermore, as the outer cylinder 24 is cooled by circulating cooling water, the outer cylinder 24 has a temperature of about 100° C., which is almost the same to that of a conventional die casting machine having a cooling passage.

A cast product made of AC4CH material whose structure is granulated by the method of this invention is compared with one made of AC4CH material according to a conventional method for their mechanical properties. The results are shown in Table

TABLE 1

| | Table strength ($N/mm^2$) | Proof stress ($N/mm^2$) | Elongation (%) |
|---|---|---|---|
| Present Example | 350 | 280 | 10 |
| Comparative Sample | 300 | 280 | 2 |

Figure 23:
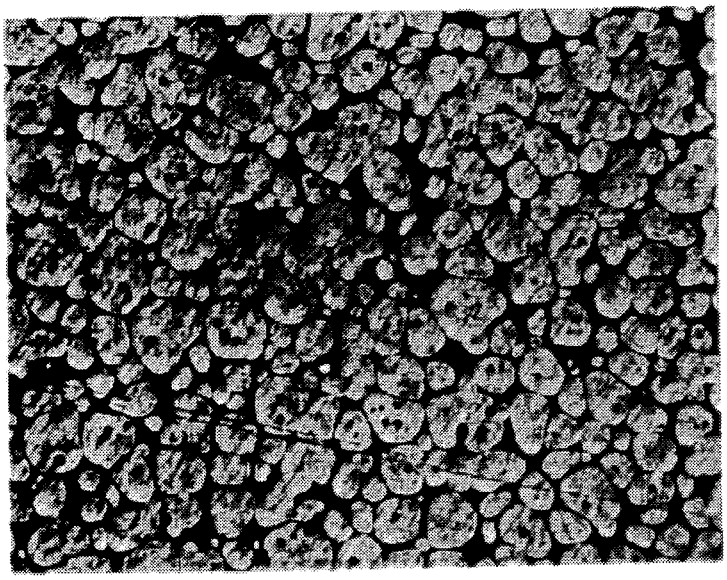
FIG. 23 is a microphotograph (50x magnification) of a cast product structure produced by a method according to the invention.
Figure 24:
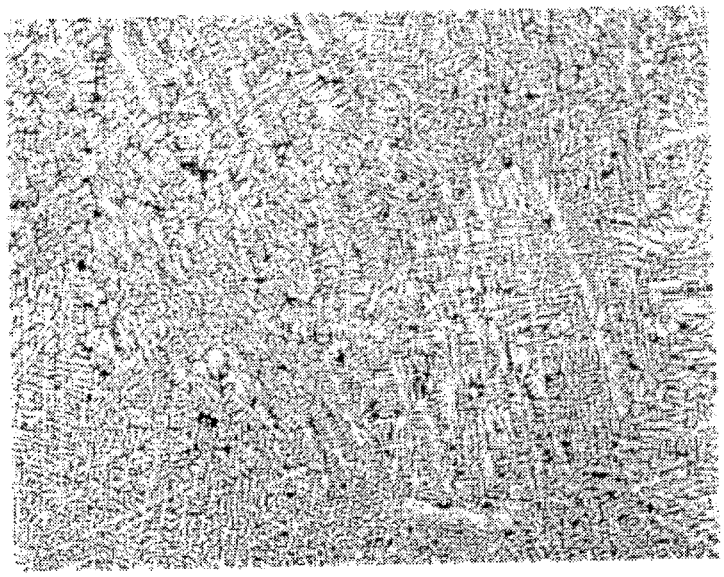
FIG. 24 is a microphotograph (50x magnification) of a cast product structure produced by a conventional method.

As shown in Table 1, the product by the present invention has better properties in tensile strength and elongation than the conventional method. FIG. 23 is a microphotograph (50x magnification) showing the structure of the present example and FIG. 24 is a microphotograph (50x magnification) showing the structure of the comparative sample. The cast product of this invention shown in FIG. 23 has a granular structure and excellent mechanical properties. On the other hand, the cast product of the conventional method shown in FIG. 24 has dendrite structure.

EXAMPLE 7

Figure 25:
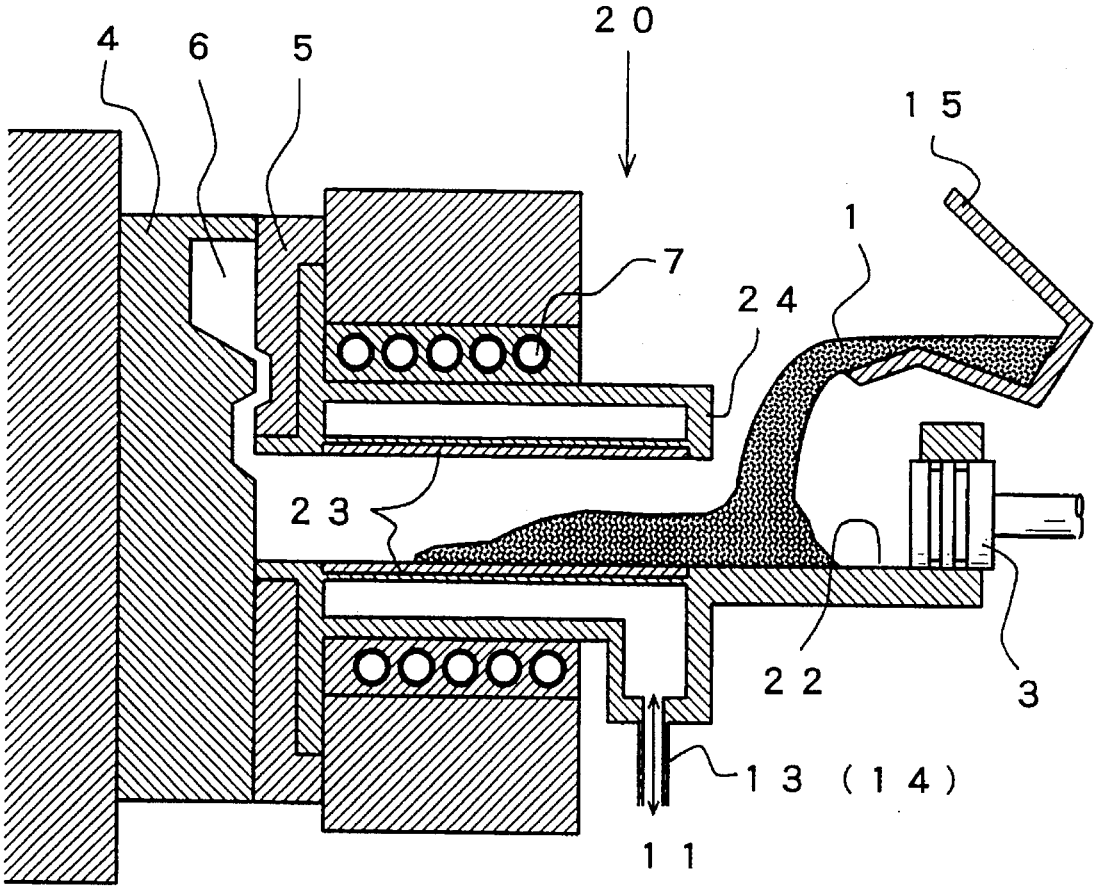
FIG. 25 is a schematic sectional view of a horizontal type die casting machine according to one embodiment of the invention.

FIG. 25 is a vertical sectional view of a horizontal type die casting machine according to another example of this invention. This machine has substantially the same structure with the die casting machine used in Example 6. Molten A357 material is fed into the casting sleeve 20 by a ladle 15 and cast under a clamping force of 350 tons. As in the case of Example 6, the cast product obtained has a granular structure and excellent mechanical properties.

EXAMPLE 8

Figure 26:
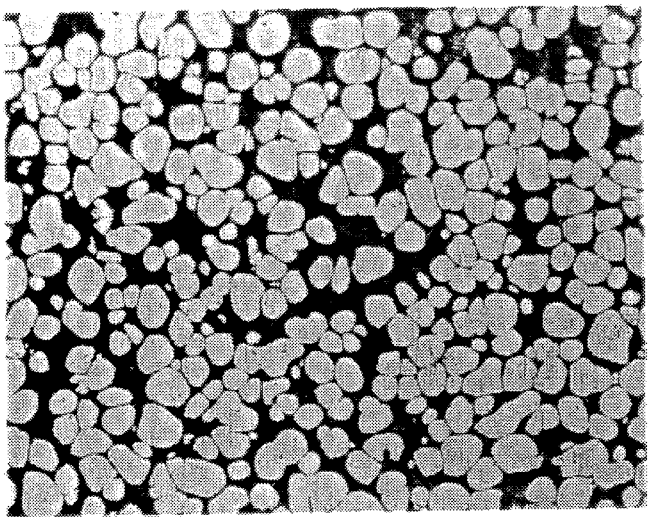
FIG. 26 is a microphotograph (50x magnification) of a cast structure produced according to one embodiment of the invention.
Figure 27:
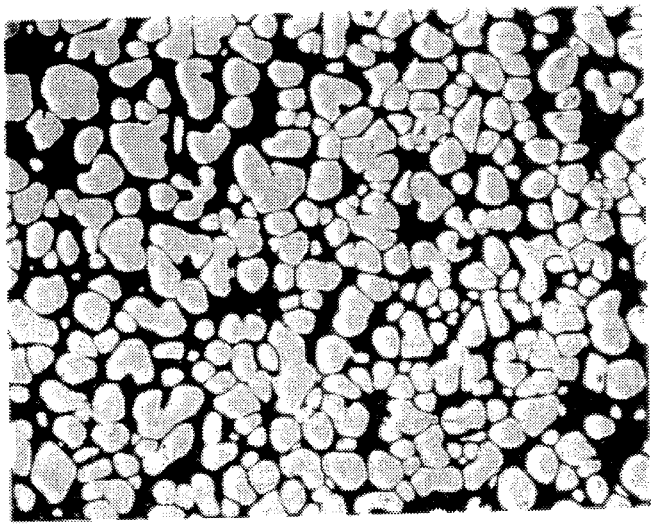
FIG. 27 is a microphotograph (50x magnification) of a cast structure produced according to one embodiment of the invention.
Figure 28:
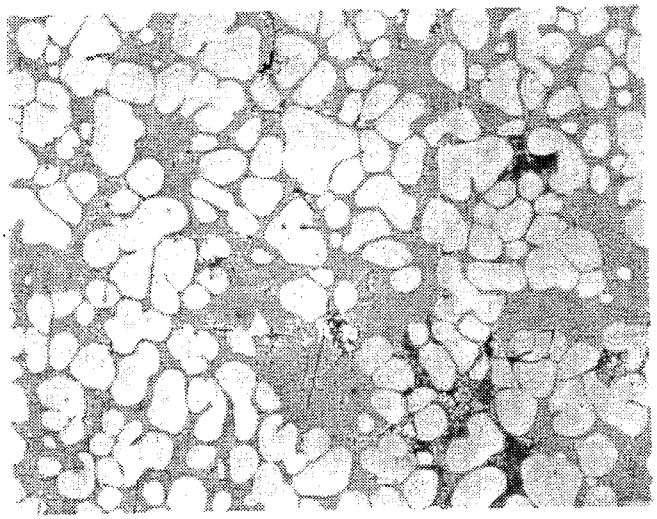
FIG. 28 is a microphotograph (50x magnification) of a cast structure produced according to one embodiment of the invention.
Figure 29:
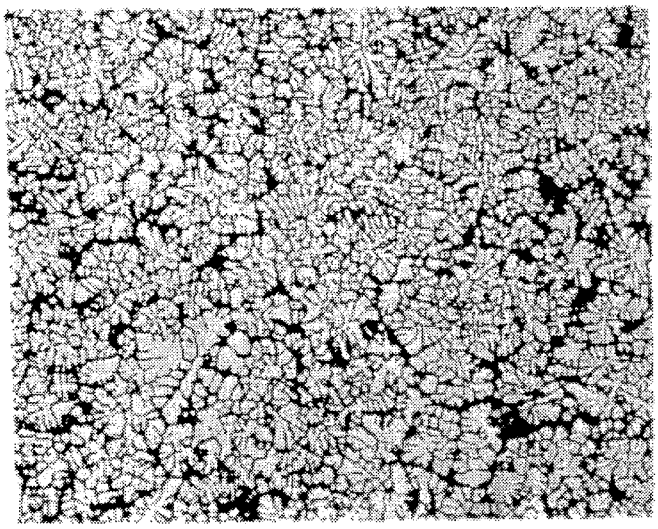
FIG. 29 is a microphotograph (50x magnification) of a cast structure produced according to one embodiment of the invention.
Figure 30:
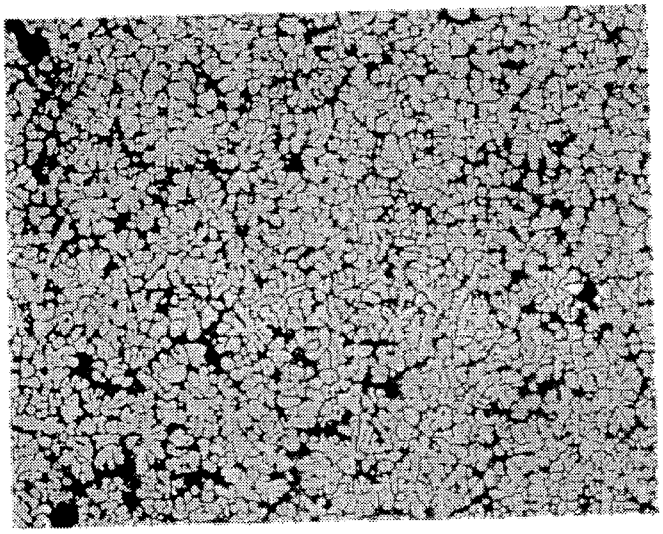
FIG. 30 is a microphotograph (50x magnification) of a cast structure produced according to one embodiment of the invention.
Figure 31:
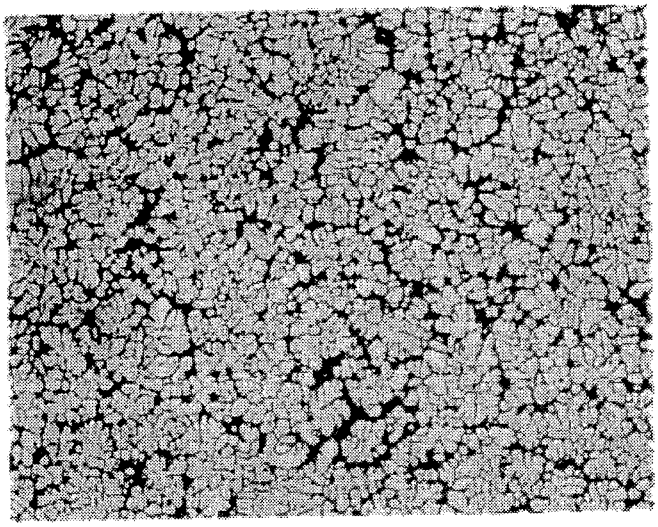
FIG. 31 is a microphotograph (50x magnification) of a cast structure produced according to one embodiment of the invention.

FIG. 26 to FIG. 31 are microphotograph (50x magnifications) showing the structure of the products cast from A357 material by following the procedure of Example 6 except that the molten metal is fed at 585° C. and 620° C., respectively and heated by induction heating having respective frequencies of about 300, 500 and 1000 Hz. FIG. 26 to FIG. 28 show the products obtained with the molten metal fed at feeding temperature of 585° C. and heated by induction heating at frequencies of about 300, 500 and 1000 Hz, respectively. FIG. 29 to FIG. 31 show the products obtained with the molten metal fed at 620° C. and heated by induction heating at frequencies of about 300, 500 and 1000 Hz, respectively.

It is seen from the figures that each cast product exhibits granular structure and excellent mechanical properties obtained by controlling the heating conditions in a range such that the temperatures of the molten metal are between at 585° C. and 620° C. and the induction heating is conducted at frequencies of about 300 to 1000 Hz.

EXAMPLE 9

Figure 32:
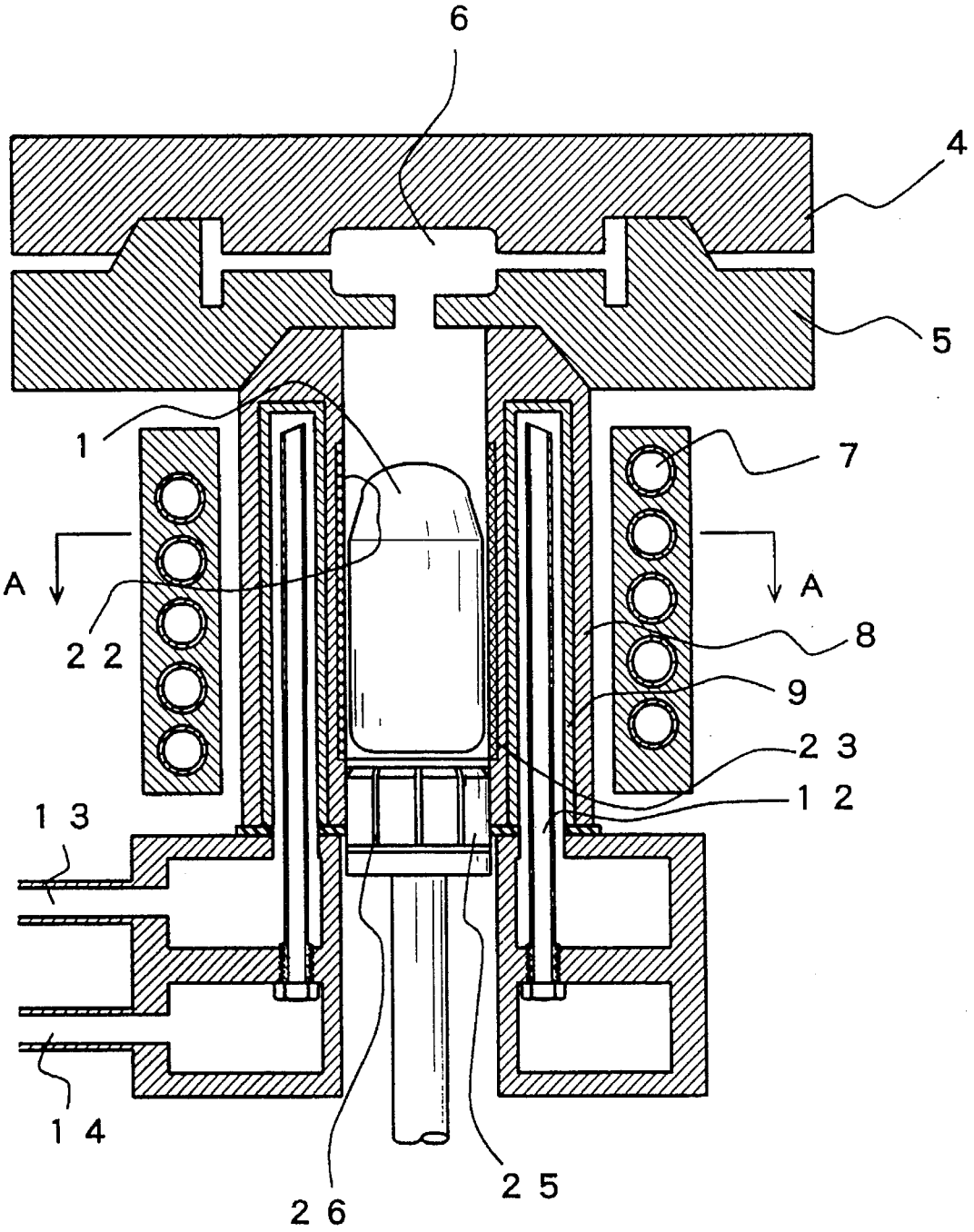
FIG. 32 is a sectional view of a vertical type die casting machine according to one embodiment of the invention.
Figure 33:
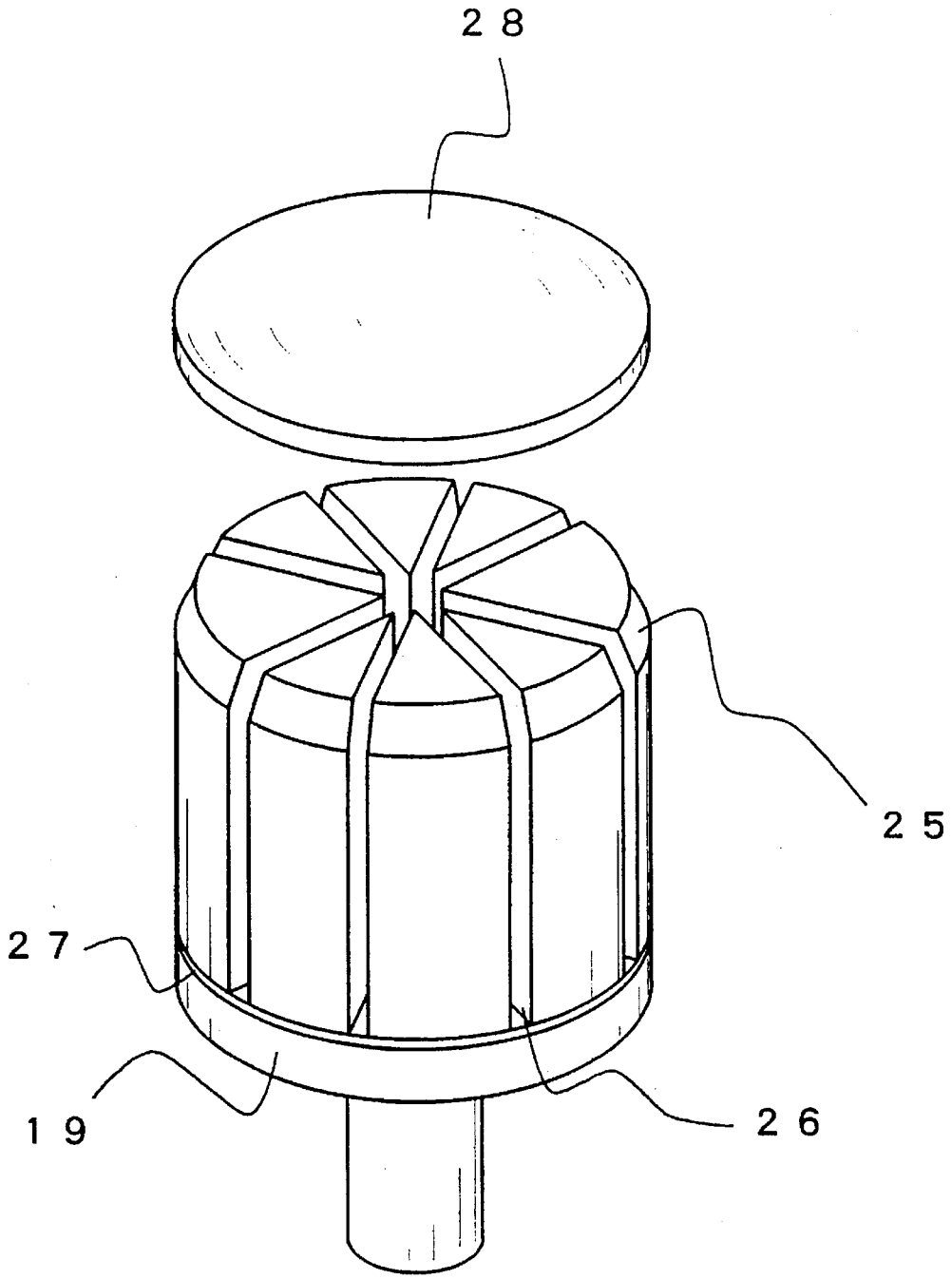
FIG. 33 is a partially enlarged perspective view of the vertical type die casting machine according to the embodiment shown in FIG. 32.
Figure 34:
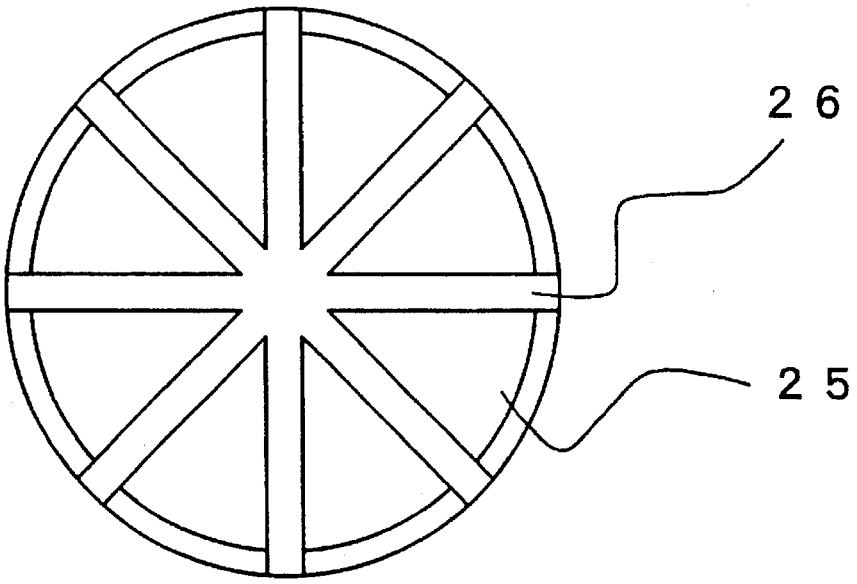
FIG. 34 is a partially enlarged plan view of the vertical type die casting machine according to the embodiment shown in FIG. 32.

FIG. 32 to FIG. 34 show a vertical type die casting machine according to another example of this invention. A casting sleeve of this machine has similar structure to that of Example 6. As shown in FIG. 33 and FIG. 34, a plunger chip 25 for forcibly charging a material 1 accommodated in a casting sleeve 2 into a cavity 6 is made of a conductive material, has slits 26, and is attached to a plunger 19 via an insulating layer 27. A non-magnetic insulator 28 can be attached to a face of the plunger chip 25 corresponding to the material to be cast as shown in FIG. 33. The non-magnetic insulator 28 can be attached in contact with the plunger chip 25 or may be merely put on the plunger chip 25.

In the die casting machine of this example, the molten metal 1 placed in the casting sleeve 2 has a shape as shown in FIG. 32 and a small contact area including the bottom with the inner surface of the casting sleeve 2. This causes the molten metal to have a rather small temperature drop.

As described above, according to a die casting method and a die casting machine of the present invention, a plurality of conductors are disposed intermittently around the material to be cast, or the inner cylinder of the casting sleeve is made of the conductive substance having formed therein slits so that an induced current is generated in the material to be cast by the induction coil via the conductors, thereby causing the material to be heated and/or maintained a constant temperature while the material is being electromagnetically stirred. Thus, the solid material is heated into a semi solid state or molten state and can be electromagnetically stirred. The material in the molten state can be cooled into a semi solid state during electromagnetic stirring by cooling with inert gas which is charged in the casting sleeve. According to above process, dendrite structure contained in the material is broken and granular crystal structure can be obtained.

Due to a current flow which is generated in the material in the molten or semi solid state and the conductors by electromagnetic induction, electromagnetic force is generated to act as a repulsion force between the material and the surface of the casting sleeve resulting in prevention of the material from contacting with the casting sleeve. Therefore, a temperature drop of the molten material due to its contact with the surface of the casting sleeve can be suppressed.

As the material can be securely maintained in non-contact state with the surface of the casting sleeve by arranging a plurality of conductors uncontinuously or disposing a conductor having slits around the material, an a.c. passed through the induction coil can be set in a range which will not only keep the material in a floated state or a state with a small contact area within the sleeve, but also heat, maintain a constant temperature of and electromagnetically stir the material.

Furthermore, at least a part of the inner cylinder of the casting sleeve is formed with a material having a low thermal conductivity, so that the material to be cast does not lose much heat and a small number of solidified pieces are formed on the surface of the material. In particular, when the ceramic material known as SIALON is applied for a part of the inner cylinder, the material has restricted wetting, has a granular structure with less solidified pieces and is cast to form a product having excellent mechanical properties.

According to above effects, short runs and cold shuts are reduced, making it possible to produce a thin and long product.

The cooling medium passages are disposed in the outer cylinder of the casting sleeve, so that a temperature increase of the outer cylinder due to electromagnetic induction can be suppressed and the inner and outer cylinders can be kept in an appropriate fitting state, thereby maintaining the machine accuracy of the casting sleeve.

In this invention, when the material to be cast is particularly molten metal, metallic slurry with a granulated solid phase or composite slurry with a granulated solid phase, the cast product has a granular structure and excels in mechanical properties.

Casting can be conducted with a material having a dendrite structure without preliminary stirring as stirring of the molten material can be made within the sleeve, providing improved workability and excellent cost efficiency. Oxidation of the material can be reduced by providing an inert gas atmosphere within the casting sleeve, and this effect can be enhanced by combining the inert gas introduction with reduced pressure in the cavity.

What is claimed is:

1. A die casting method comprising the steps of:

circumferentially disposing a plurality of conductors around a material to be cast which is put in an accommodating section of a casting machine;

generating a magnetic field to the conductors by means of an induction coil to cause induction heating and electromagnetic stirring of the material to be cast; and charging the material to be cast into a product cavity by a forced entry means.

2. A die casting method according to claim 1, wherein the inductively heated material is maintained a constant temperature in a casting sleeve of a casting machine.

3. A die casting method according to claim 1, further comprising the steps of disposing a plurality of conductors in a forced entry means for charging the material to be cast into the product cavity, and generating the magnetic field to the conductors by means of the induction coil.

4. A die casting method according to claim 1, further comprising the steps of forming a forced entry means for charging the material to be cast into the product cavity, with a conductor having a plurality of slits, and generating the magnetic field to the conductor by means of the induction coil.

5. A die casting method according to claim 3, wherein a non-magnetic insulator is attached to a part of the forced entry means which corresponds to the material to be cast.

6. A die casting method according to claim 4, wherein a non-magnetic insulator is attached to a part of the forced entry means which corresponds to the material to be cast.

7. A die casting method according to claim 1, wherein the material to be cast in partly or entirely separated from the wall face of the accommodating section by an electromagnetic force.

8. A die casting method according to claim 3, wherein the material to be cast is partly or entirely separated from the wall face of the accommodating section by an electromagnetic force.

9. A die casting method according to claim 4, wherein the material to be cast is partly or entirely separated from the wall face of the accommodating section by an electromagnetic force.

10. A die casting method according to claim 1, wherein the material to be cast contains 10 to 80% of a solid phase prior to the charging of the material into the product cavity.

11. A die casting method according to claim 1, wherein the material to be cast is supplied in a semi solid state.

12. A die casting method according to claim 1, wherein the material to be cast is supplied in a molten state.

13. A die casting method according to claim 1, wherein the material to be cast is supplied in a solid state.

14. A die casting method according to claim 1, wherein inert gas is introduced into the accommodating section.

15. A die casting method according to claim 1, wherein the conductors are made of a non-magnetic material.

16. A die casting method according to claim 3, wherein the conductors are made of a non-magnetic material.

17. A die casting method according to claim 4, wherein the conductors are made of a non-magnetic material.

18. A die casting method according to claim 1, wherein an a.c. passed through the induction coil is set to have a frequency of 300 Hz to 1000 Hz.

19. A die casting method according to claim 3, wherein an a.c. passed through the induction coil is set to have a frequency of 300 Hz to 1000 Hz.

20. A die casting method according to claim 4, wherein an a.c. passed through the induction coil is set to have a frequency of 300 Hz to 1000 Hz.

21. A die casting method according to claim 1, wherein the casting sleeve interior is decompressed.

22. A die casting method comprising the steps of:

disposing a conductor having a plurality of slits around a material to be cast which is put in an accommodating section of a casting machine;

generating a magnetic field to the conductor by means of an induction coil to cause induction heating and electromagnetic stirring of the material to be cast; and charging the material to be cast into a product cavity by a forced entry means.

23. A die casting method according to claim 22, wherein the inductively heated material is in a casting sleeve of a casting machine.

24. A die casting method comprising the steps of:

forming a casting sleeve comprising a plurality of conductors disposed in its inner circumference;

disposing an induction coil on the outer periphery of the casting sleeve;

generating a magnetic field to the conductors by means of the induction coil to inductively heat and electromagnetically stir the material to be cast accommodated in the casting sleeve; and charging the material to be cast into a product cavity by a forced entry means.

25. A die casting method comprising the steps of:

forming at least a part of a casting sleeve with a conductor having a plurality of slits;

disposing an induction coil on the outer periphery of the casting sleeve;

generating a magnetic field to the conductor by means of the induction coil to inductively heat and electromagnetically stir the material to be cast accommodated in the sleeve; and charging the material to be cast into a product cavity by a forced entry means.

26. A die casting method comprising the steps of:

forming a casting sleeve comprising inner and outer cylinders, wherein at least part of the inner cylinder is made of a substance having a low thermal conductivity and at least a part of the outer cylinder is formed with a conductor having a plurality of slits;

disposing an induction coil on the outer periphery of the outer cylinder;

generating a magnetic field to the conductor by means of the induction coil to inductively heat and electromagnetically stir a material to be cast; and charging the material to be cast into a product cavity by a forced entry means.

27. A die casting method according to claim 26, wherein the substance having a low thermal conductivity is a ceramic material.

28. A die casting method comprising the steps of:

forming a casting sleeve comprising inner and outer cylinders, wherein at least a part of the inner cylinder is made of a substance having a low thermal conductivity and the outer cylinder comprises a plurality of conductors disposed in the inner circumference;

disposing an induction coil on the outer periphery of the outer cylinder;

generating a magnetic field to the conductors by means of the induction coil to inductively heat and electromagnetically stir a material to be cast; and charging the material to be cast into a product cavity by a forced entry means.

29. A die casting method according to claim 28, wherein the substance having a low thermal conductivity is a ceramic material.

30. A die casting machine comprising a product cavity formed by closed dies, an accommodating section for housing a material to be cast which is in communication with the product cavity, a forced entry means for forcing the housed material into the product cavity, a conducting section comprising a plurality of circumferentially disposed conductors around the accommodating section, and an induction coil wound on the outer periphery of the conducting section.

31. A die casting machine according to claim 30, wherein the forced entry means has a plurality of conductors disposed therein.

32. A die casting machine according to claim 30, wherein at least a part of the forced entry means is formed by a conductor having a plurality of slits.

33. A die casting machine according to claim 31, wherein a non-magnetic insulator is attached to a part of the forced entry means corresponding to the material to be cast.

34. A die casting machine according to claim 32, wherein a non-magnetic insulator is attached to a part of the forced entry means corresponding to the material to be cast.

35. A die casting machine according to claim 30, wherein the conductors are cooled by a cooling means.

36. A die casting machine according to claim 30, wherein a non-conductive substance is filled between the conductors.

37. A die casting machine according to claim 31, wherein a non-conductive substance is filled between the conductors.

38. A die casting machine according to claim 32, wherein a non-conductive substance is filled between the conductors.

39. A die casting machine according to claim 30, wherein the conductors are made of a non-magnetic material.

40. A die casting machine according to claim 31, wherein the conductors are made of a non-magnetic material.

41. A die casting machine according to claim 32, wherein the conductors are made of a non-magnetic material.

42. A die casting machine comprising a product cavity formed by closed dies, an accommodating section for housing a material to be cast which is in communication with the product cavity, a forced entry means for forcing the housed material into the product cavity, a conductor having a plurality of slits disposed around the accommodating section, and an induction coil wound on the outer periphery of the conductor.

43. A die casting machine comprising a product cavity formed by closed dies, a casting sleeve for housing a material to be cast which is in communication with the product cavity, a forced entry means for forcing the housed material into the product cavity, a conducting section in which a plurality of conductors are disposed along the inner circumference of the casting sleeve, and an induction coil wound on the outer periphery of the casting sleeve.

44. A die casting machine comprising a product cavity formed by closed dies, a casting sleeve for housing a material to be cast which is in communication with the product cavity and is formed by a conductor having a plurality of slits, a forced entry means for forcing the housed material into the product cavity, and an induction coil wound on the outer periphery of the casting sleeve.

45. A die-casting machine comprising a product cavity formed by closed dies, a casting sleeve for housing a material to be cast which is in communication with the product cavity, and a forced entry means for forcing the housed material into the product cavity, wherein the casting sleeve comprises an inner cylinder which is at least in part made of a substance having a low thermal conductivity and an outer cylinder which is at least in part made of a conductor having a plurality of slits, and wherein an induction coil is wound on the outer periphery of the outer cylinder.

46. A die casting machine according to claim 34, wherein the substance having a low thermal conductivity is a ceramic material.

47. A die casting machine according to claim 45, wherein a cooling medium passage is disposed in the outer cylinder.

48. A die-casting machine comprising a product cavity formed by closed dies, a casting sleeve for housing a material to be cast which is in communication with the product cavity, and a forced entry means for forcing the housed material into the product cavity, wherein the casting sleeve comprises an inner cylinder which is at least in part made of a substance having a low thermal conductivity and an outer cylinder having at least a part of its inner circumference provided with a plurality of conductors, and wherein an induction coil is wound on the outer periphery of the outer cylinder.

49. A die casting machine according to claim 35, wherein the substance having a low thermal conductivity is a ceramic material.

50. A die casting machine according to claim 48, wherein a cooling medium passage is disposed in the outer cylinder.

* * * * *